US007567678B2

(12) United States Patent
Kong et al.

(10) Patent No.: US 7,567,678 B2
(45) Date of Patent: Jul. 28, 2009

(54) MICROPHONE ARRAY METHOD AND SYSTEM, AND SPEECH RECOGNITION METHOD AND SYSTEM USING THE SAME

(75) Inventors: Dong-geon Kong, Busan (KR); Chang-kyu Choi, Seoul (KR); Seok-won Bang, Seoul (KR); Bon-young Lee, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1055 days.

(21) Appl. No.: 10/836,207

(22) Filed: May 3, 2004

(65) Prior Publication Data

US 2004/0220800 A1 Nov. 4, 2004

(30) Foreign Application Priority Data

May 2, 2003 (KR) ..... 10-2003-0028340
Feb. 26, 2004 (KR) ..... 10-2004-0013029

(51) Int. Cl.
*H04R 3/00* (2006.01)

(52) U.S. Cl. ..... 381/92; 381/94.3; 381/98; 704/233

(58) Field of Classification Search ..... 381/92, 381/98, 122, 94.2, 94.3, 26, 111; 704/233, 704/226, 246; 367/99
See application file for complete search history.

(56) References Cited

U.S. PATENT DOCUMENTS 4,882,755 A * 11/1989 Yamada et al. ..... 704/239
(Continued)

FOREIGN PATENT DOCUMENTS

JP 11-041687 2/1999

(Continued)

OTHER PUBLICATIONS

L.J. Griffths et al., An alternative Approach to Linearly Constrained Adaptive Beamforming, IEEE Transactions on Antennas and Propagation, vol. AP-30, No. 1, Jan. 1982, pp. 27-34.

(Continued)

*Primary Examiner*—Vivian Chin
*Assistant Examiner*—Jason R Kurr
(74) *Attorney, Agent, or Firm*—Staas & Halsey LLP

(57) ABSTRACT

A microphone array system including an input unit to receive sound signals using a plurality of microphones; a frequency splitter splitting each sound signal received into a plurality of narrowband signals; an average spatial covariance matrix estimator using spatial smoothing to obtain a spatial covariance matrix for each frequency component of the sound signal, by which spatial covariance matrices for a plurality of virtual sub-arrays, which are configured in the plurality of microphones, are obtained with respect to each frequency component of the sound signal and an average spatial covariance matrix is calculated; a signal source location detector to detect an incidence angle of the sound signal according to the average spatial covariance matrix calculated; a signal distortion compensator to calculates a weight for each frequency component of the sound signal based on the incidence angle of the sound signal and multiply the calculated weight by each frequency component.

49 Claims, 21 Drawing Sheets
(1 of 21 Drawing Sheet(s) Filed in Color)

U.S. PATENT DOCUMENTS

| | | | | |
|---|---|---|---|---|
| 5,539,859 | A * | 7/1996 | Robbe et al. | 704/233 |
| 6,594,367 | B1 * | 7/2003 | Marash et al. | 381/92 |
| 6,952,482 | B2 * | 10/2005 | Balan et al. | 381/94.1 |
| 7,084,801 | B2 * | 8/2006 | Balan et al. | 341/155 |
| 7,146,315 | B2 * | 12/2006 | Balan et al. | 704/233 |

FOREIGN PATENT DOCUMENTS

| | | |
|---|---|---|
| JP | 11-052977 | 2/1999 |
| JP | 11-164389 | 6/1999 |
| JP | 2000-221999 | 8/2000 |

OTHER PUBLICATIONS

J. Capon, High-Resolution Frequency-Wavenumber Spectrum Analysis, Proceedings of the IEEE, vol. 57, No. 8, Aug. 1969, pp. 1408-1419.

F. Asano et al., Sound Source Localization and Signail Separation for Office Robot "Jijo-2", Proceeding of the 1999 IEEE International Conference on Multisensor Fusion and Integration for Intelligent Systems Taipei, Taiwan, ROC, Aug. 1999, pp. 243-248.

D. B. Ward, Technique for Broadband Correlated Interference Rejection in Microphone Arrays, IEEE Transactions on Speech and Audio Processing, vol. 6, No. 4, Jul. 1998, pp. 414-417.

A. Zeira et al., Interpolated Array Minimum Variance Beamforming for Correlated Interference Rejection, 0-7803-3192/3/96 $5.00 © 1996 IEEE, pp. 3165-3168.

Office Action issued on Mar. 4, 2008 in the corresponding Japanese Patent Application No. 2004-137875 (3 pages).

Futoshi Asano, et al., "Speech Enhancement Based on the Subspace Method", IEEE Transactions on Speech and Audio Processing, vol. 8, No. 5, Sep. 2000 (pp. 497-507).

K. Farrell, et al., "Beamforming Microphone Arrays for Speech Enhancement", Center for Computer Aids for Industrial Productivity, Rutgers University, Piscataway, New Jersey 08855 (pp. I-285-I-288).

Iain A. McCown, et al., "Adaptive Parameter Compensation for Robust Hands-Free Speech Recognition Using a Dual Beamforming Microphone Array", Proceedings of 2001 International Symposium on Intelligent Multimedia, Video and Speech Processing, May 24, 2001, Hong Kong (pp. 547-550).

* cited by examiner

FIG. 10(A)(1)
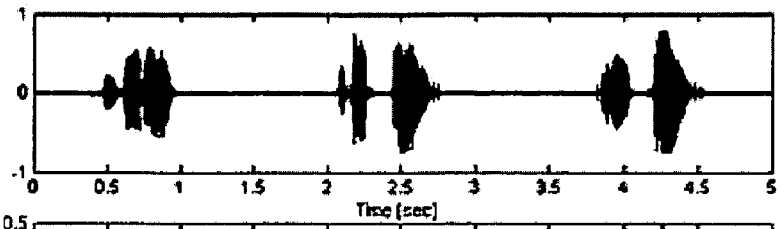
FIG. 10(A)(2)
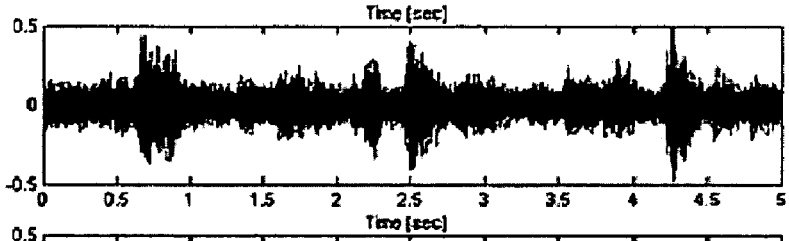
FIG. 10(A)(3)
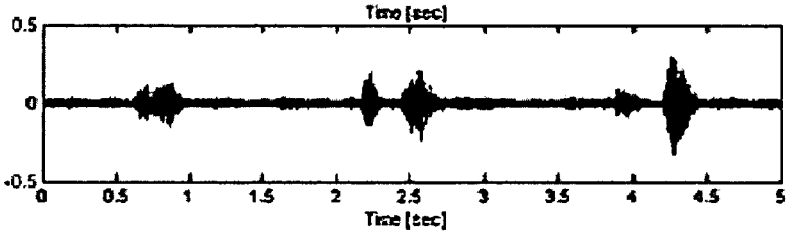

FIG. 10(B)(1)
FIG. 10(B)(2)
FIG. 10(B)(3)
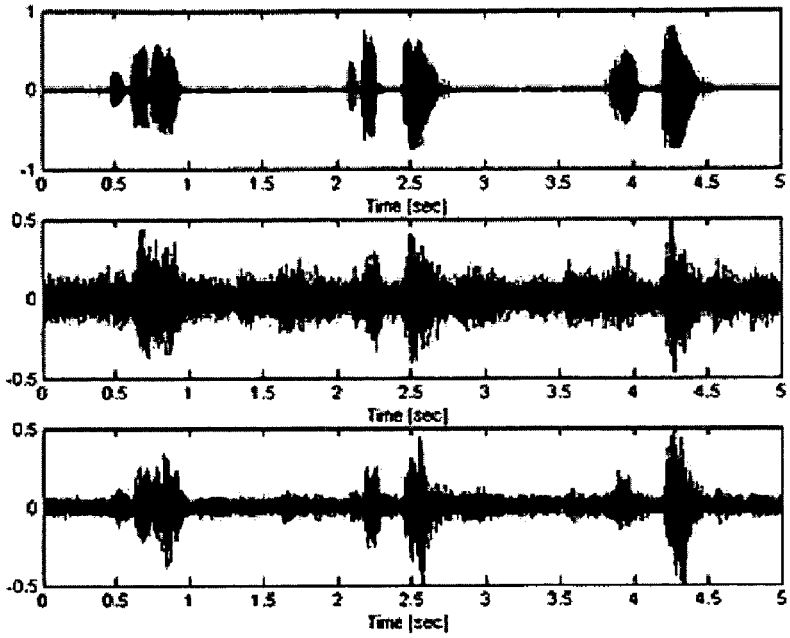

MICROPHONE ARRAY METHOD AND SYSTEM, AND SPEECH RECOGNITION METHOD AND SYSTEM USING THE SAME

CROSS-REFERENCE TO RELATED APPLICATIONS

This application claims the priority of Korean Patent Application Nos. 10-2003-0028340 and 10-2004-0013029 filed on May 2, 2003 and Feb. 26, 2004, respectively, in the Korean Intellectual Property Office, the disclosures of which are incorporated herein by reference.

BACKGROUND OF THE INVENTION

1. Field of the Invention

The present invention relates to a microphone array method and system, and more particularly, to a microphone array method and system for effectively receiving a target signal among signals input into a microphone array, a method of decreasing the amount of computation required for a multiple signal classification (MUSIC) algorithm used in the microphone array method and system, and a speech recognition method and system using the microphone array method and system.

2. Description of the Related Art

With the development of multimedia technology and the pursuit of a more comfortable life, controlling household appliances such as televisions (TVs) and digital video disc (DVD) players with speech recognition has been increasingly researched and developed. To realize a human-machine interface (HMI), a speech input module receiving a user's speech and a speech recognition module recognizing the user's speech are needed. In an actual environment of a speech interface, a user's speech, as well as interference signals, such as music, TV sound, and ambient noise, are present. To implement a speech interface for a HMI in the actual environment, a speech input module capable of acquiring a high-quality speech signal regardless of ambient noise and interference is needed.

A microphone array method uses spatial filtering in which a high gain is given to signals from a particular direction and a low gain is given to signals from other directions, thereby acquiring a high-quality speech signal. A lot of research and development for increasing the performance of speech recognition by acquiring a high-quality speech signal using such a microphone array method has been conducted. However, because a speech signal has a wider bandwidth than a narrow bandwidth which is a primary condition in array signal processing technology, and due to problems caused by, for example, various echoes in an indoor environment, it is difficult to actually use the microphone array method for a speech interface.

To overcome these problems, an adaptive microphone array method based on a generalized sidelobe canceller (GSC) may be used. Such an adaptive microphone array method has advantages of a simple structure and a high signal to interface and noise ration (SINR). However, performance deteriorates due to an incidence angle estimation error and indoor echoes. Accordingly, an adaptive algorithm robust to the estimation error and echoes is desired.

In addition, there are wideband minimum variance (MV) methods in which a minimum variance distortionless response (MVDR) may be applied to wideband signals. Wideband MV methods are divided into MV methods and maximum likelihood (ML) methods according to a scheme of configuring an autocorrelation matrix of a signal. In each method, a variety of schemes of configuring the autocorrelation matrix have been proposed for example, a microphone array based on a wideband MV method may be used by, etc.

The following description concerns a conventional microphone array method. When D signal sources are incident on a microphone array having M microphones in directions θ=, assuming that θ1 is a direction of a target signal and the remaining directions are those of interference signals. Discrete Fourier transforming data input to the microphone array and signal modeling are performed by expressing a vector of frequency components obtained by the discrete Fourier transformation, shown in Equation (1). Hereinafter, the vector of frequency components is referred to as a frequency bin.

$$x_k = A_k s_k + n_k \tag{1}$$

Here, $x_k=[X_{1,k} \ldots X_{m,k} \ldots X_{M,k}]^T$, $A_k=[a_k(\theta_1) \ldots a_k(\theta_d) \ldots a_k(\theta_D)]$, $s_k=[S_{1,k} \ldots S_{d,k} \ldots S_{D,k}]^T$, $n_k=[N_{1,k} \ldots N_{m,k} \ldots N_{M,k}]^T$, and "k" is a frequency index. $X_{m,k}$ and $N_{m,k}$ are discrete Fourier transform (DFT) values of a signal and background noise, respectively, observed at an m-th microphone, and $S_{d,k}$ is a DFT value of a d-th signal source. $a_k(\theta_d)$ is a directional vector of a k-th frequency component of the d-th signal source and can be expressed as Equation (2).

$$a_k(\theta_d)=[e^{-jw_k\tau_{k,1}(\theta_d)} \ldots e^{-jw_k\tau_{k,m}(\theta_d)} \ldots e^{-jw_k\tau_{k,M}(\theta_d)}]^T \tag{2}$$

Here, $\tau_{k,m}(\theta_d)$ is the delay time taken by the k-th frequency component of the d-th signal source to reach the m-th microphone.

An incidence angle of a wideband signal is estimated by discrete Fourier transforming an array input signal, applying a MUSIC algorithm to each frequency component, and finding the average of MUSIC algorithm application results with respect to a frequency band of interest. A pseudo space spectrum of the k-th frequency component is defined as Equation (3).

$$P_k(\theta) = \frac{a_k^H(\theta)a_k(\theta)}{a_k^H(\theta)U_{n,k}U_{n,k}^H a_k(\theta)} \tag{3}$$

Here, $U_{n,k}$ indicates a matrix consisting of noise eigenvectors with respect to the k-th frequency component, and $a_k(\theta)$ indicates a narrowband directional vector with respect to the k-th frequency component. When the incidence angle of the wideband signal $a_k(\theta)$ is identical to an incidence angle of a temporary signal source, the denominator of the pseudo space spectrum becomes "0" because a directional vector is orthogonal to a noise subspace. As a result, the pseudo space spectrum has an infinite peak. An angle corresponding to the infinite peak indicates an incidence direction. Here, an average pseudo space spectrum can be expressed as Equation (4).

$$\overline{P}(\theta) = \frac{1}{k_H - k_L}\sum_{k=k_L}^{k_H} P_k(\theta) \tag{4}$$

Here, $k_L$ and $k_H$ respectively indicate indexes of a lowest frequency and a highest frequency of the frequency band of interest.

In a wideband MV algorithm, a wideband speech signal is discrete Fourier transformed, and then a narrowband MV algorithm is applied to each frequency component. An optimization problem for obtaining a weight vector is derived from a beam-forming method using different linear constraints for different frequencies.

$$\min_{w_k} w_k^H R_k w_k \text{ subject to } a_k^H(\theta_1) w_k = 1 \quad (5)$$

Here, a spatial covariance matrix $R_k$ is expressed as Equation (6).

$$R_k = E[x_k x_k^H] \quad (6)$$

When Equation (6) is solved using a Lagrange multiplier, a weight vector $w_k$ is expressed as Equation (7).

$$w_{k_{mv}} = \frac{R_k^{-1} a_k(\theta_1)}{a_k^H(\theta_1) R_k^{-1} a_k(\theta_1)} \quad (7)$$

Wideband MV methods are divided into two types of methods according to a scheme of estimating the spatial covariance matrix $R_k$ in Equation (7): (1) MV beamforming methods in which a weight is obtained in a section where a target signal and noise are present together; and (2) SINR beamforming methods or Maximum Likelihood (ML) methods in which a weight is obtained in a section where only noise without a target signal is present.

FIG. 1 illustrates a conventional microphone array system. The conventional microphone array system integrates an incidence estimation method and a wideband beamforming method. The conventional microphone array system decomposes a sound signal input into an input unit 1 having a plurality of microphones into a plurality of narrowband signals using a discrete Fourier transformer 2 and estimates a spatial covariance matrix corresponding to each narrowband signal using a speech signal detector 3, and a spatial covariance matrix estimator 4. The speech signal detector 3 distinguishes a speech section from a noise section. A wideband MUSIC module 5 performs eigenvalue decomposition of the estimated spatial covariance matrix, thereby obtaining an eigenvector corresponding to a noise subspace, and calculates an average pseudo space spectrum using Equation (4), thereby obtaining direction information of a target signal. Thereafter, a wideband MV module 6 calculates a weight vector corresponding to each frequency component using Equation (7) and multiplies the weight vector by each corresponding frequency component. An inverse discrete Fourier transformer 7 restores compensated frequency components to the sound signal.

The above discussed conventional system reliably operates when estimating a spatial covariance matrix in a section having only an interference signal without a speech signal. However, when obtaining a spatial covariance matrix in a section having a target signal, the conventional system removes the target signal as well as the interference signal. This result occurs because the target signal is transmitted along multiple paths as well as a direct path due to echoing. In other words, echoed target signals transmitted in directions other than a direction of a direct target signal are considered as interference signals, and the direct target signal having a correlation with the echoed target signals is also removed.

To overcome the above-discussed problem, a method or a system for effectively acquiring a target signal with less effect of an echo is desired.

In addition, a method of decreasing the amount of computation required for the MUSIC algorithm is also desired because the wideband MUSIC module 5 performs a MUSIC algorithm with respect to each frequency bin, which puts a heavy load on the system.

SUMMARY OF THE INVENTION

The invention provides a microphone array method and system robust to an echoing environment.

The invention also provides a speech recognition method and system robust to an echoing environment using the microphone array method and system.

The invention also provides a method of decreasing the amount of computation required for a multiple signal classification (MUSIC) algorithm, which is used to recognize a direction of speech, by reducing the number of frequency bins.

According to an aspect of the invention, there is provided a microphone array system comprising an input unit which receives sound signals using a plurality of microphones; a frequency splitter which splits each sound signal received through the input unit into a plurality of narrowband signals; an average spatial covariance matrix estimator which uses spatial smoothing, by which spatial covariance matrices for a plurality of virtual sub-arrays, which are configured in the plurality of microphones comprised in the input unit, are obtained with respect to each frequency component of the sound signal processed by the frequency splitter and then an average spatial covariance matrix is calculated, to obtain a spatial covariance matrix for each frequency component of the sound signal; a signal source location detector which detects an incidence angle of the sound signal based on the average spatial covariance matrix calculated using the spatial smoothing; a signal distortion compensator which calculates a weight for each frequency component of the sound signal based on the incidence angle of the sound signal and multiplies the weight by each frequency component, thereby compensating for distortion of each frequency component; and a signal restoring unit which restores a sound signal using distortion compensated frequency components.

The frequency splitter uses discrete Fourier transform to split each sound signal into the plurality of narrowband signals, and the signal restoring unit uses inverse discrete Fourier transform to restore the sound signal.

According to another aspect of the invention, there is provided a speech recognition system comprising the microphone array system, a feature extractor which extracts a feature of a sound signal received from the microphone array system, a reference pattern storage unit which stores reference patterns to be compared with the extracted feature, a comparator which compares the extracted feature with the reference patterns stored in the reference pattern storage unit, and a determiner which determines based on a comparison result whether a speech is recognized.

According to another aspect of the invention, there is provided a microphone array method comprising receiving wideband sound signals from an array comprising a plurality of microphones, splitting each wideband sound signal into a plurality of narrowbands, obtaining spatial covariance matrices for a plurality of virtual sub-arrays, which are configured to comprise a plurality of microphones constituting the array of the plurality of microphones, with respect to each narrowband using a predetermined scheme and averaging the obtained spatial covariance matrices, thereby obtaining an average spatial covariance matrix for each narrowband, calculating an incidence angle of each wideband sound signal using the average spatial covariance matrix for each narrowband and a predetermined algorithm, calculating weights to be respectively multiplied by the narrowbands based on the incidence angle of the wideband sound signal and multiplying the weights by the respective narrowbands, and restoring a wideband sound signal using the narrowbands after being multiplied by the weights respectively.

In the microphone array method, discrete Fourier transform is used to split each sound signal into the plurality of narrowband signals, and inverse discrete Fourier transform is used to restore the sound signal.

According to another aspect of the invention, there is provided a speech recognition method comprising extracting a feature of a sound signal received from the microphone array system, storing reference patterns to be compared with the extracted feature, comparing the extracted feature with the reference patterns stored in the reference pattern storage unit, and determining based on a comparison result whether a speech is recognized.

Additional aspects and/or advantages of the invention will be set forth in part in the description which follows and, in part, will be obvious from the description, or may be learned by practice of the invention.

BRIEF DESCRIPTION OF THE DRAWINGS

The patent or application file contains at least one drawing executed in color. Copies of this patent or patent application publication with color drawing(s) will be provided by the U.S. Patent and Trademark Office upon request and payment of the necessary fee. The above and other features and advantages of the present invention will become more apparent by describing in detail preferred embodiments thereof with reference to the attached drawings in which:

FIGS. 10(A)(1)-(3) shows a waveform of an output signal with respect to a reference signal in a conventional method;

FIG. 10(B) shows a waveform of an output signal with respect to a reference signal in an embodiment of the invention;

DETAILED DESCRIPTION OF THE PREFERRED EMBODIMENTS

Figure 1:
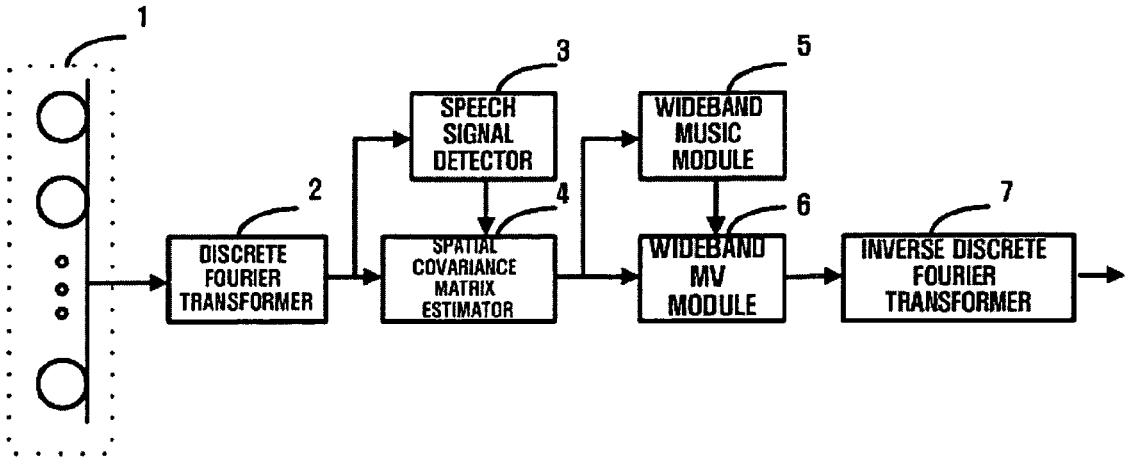
FIG. 1 (PRIOR ART)
FIG. 1 is a block diagram of a conventional microphone array system.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
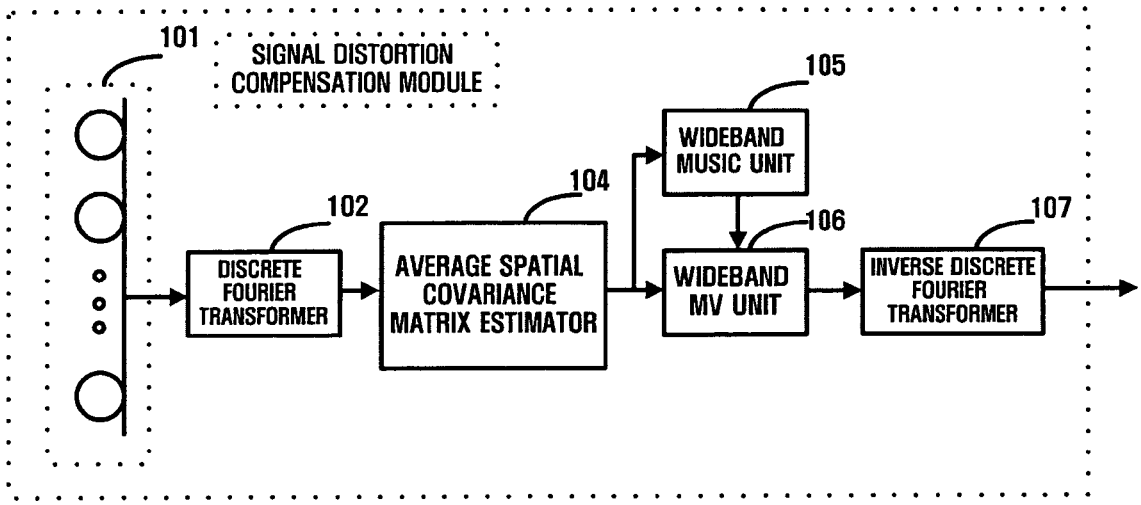
FIG. 2 is a block diagram of a microphone array system according to an embodiment of the invention.

FIG. 2 is a block diagram of a microphone array system according to an aspect of the present invention.

As shown in FIG. 2, in a microphone array system, an input unit 101 using an array of M microphones including a sub-array receives a sound signal. Here, it is assumed that the array of the M microphones includes virtual sub-arrays of L microphones. A scheme of configuring the sub-arrays will be described later with reference to FIG. 4.

M sound signals input through the M microphones are input to a discrete Fourier transformer 102 to be decomposed into narrowband frequency signals. In an aspect of the invention, a wideband sound signal such as a speech signal is decomposed into N narrowband frequency components using a discrete Fourier transform (DFT). However, the speech signal may be decomposed into N narrowband frequency components by methods other than a discrete Fourier transform (DFT).

The discrete Fourier transformer 102 splits each sound signal into N frequency components. An average spatial covariance matrix estimator 104 obtains spatial covariance matrices with respect to the M sound signals referring to the sub-arrays of L microphones and averages the spatial covariance matrices, thereby obtaining N average spatial covariance matrices for the respective N frequency components. Obtaining average spatial covariance matrices will be described later with reference to FIG. 5.

A wideband multiple signal classification (MUSIC) unit 105 calculates a location of a signal source using the average spatial covariance matrices. A wideband minimum variance (MV) unit 106 calculates a weight matrix to be multiplied by each frequency component using the result of calculating the location of the signal source and compensates for distortion due to noise and an echo of a target signal using the calculated weight matrices. An inverse discrete Fourier transformer 107 restores the compensated N frequency components to the sound signal.

Figure 3:
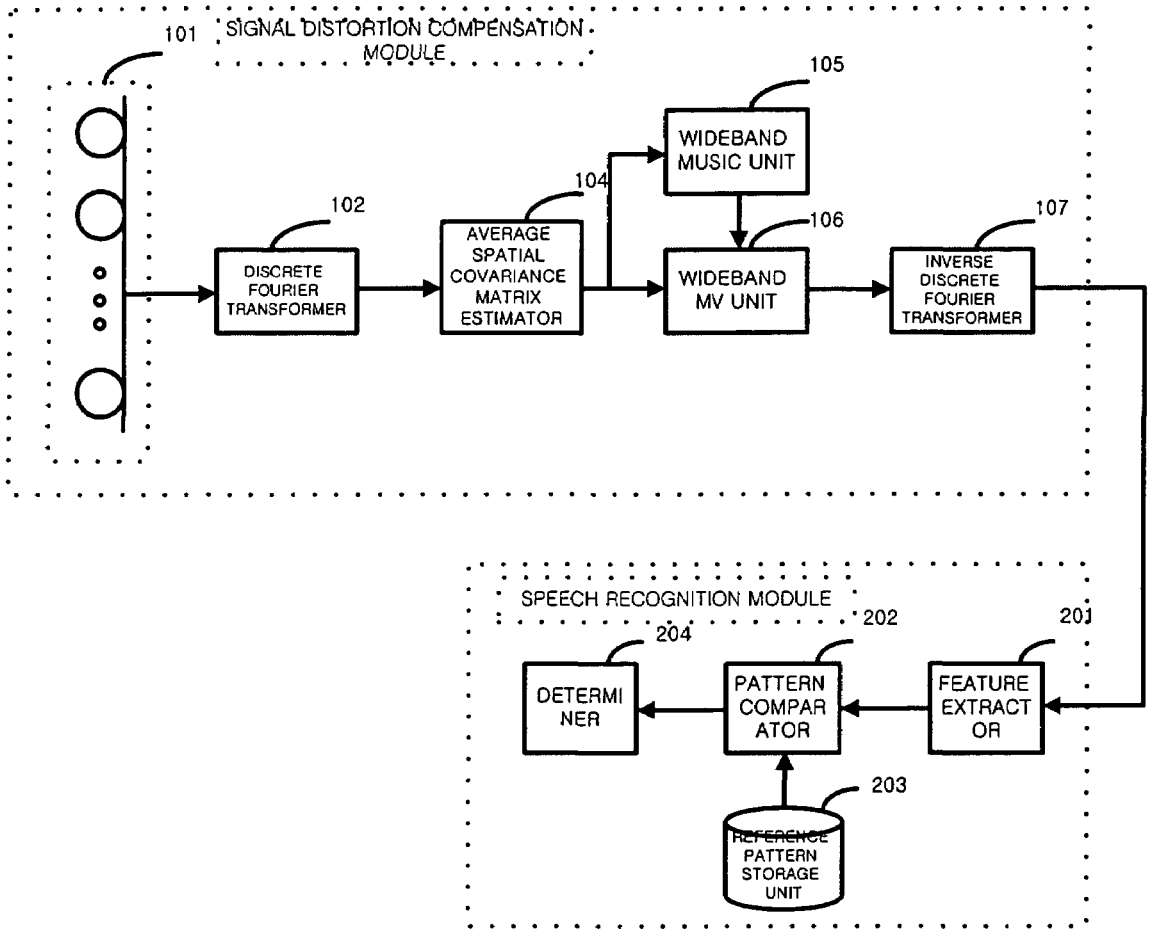
FIG. 3 is a block diagram of a speech recognition system using a microphone array system, according to an embodiment of the invention.

FIG. 3 illustrates a speech recognition system including the microphone array, i.e., a signal distortion compensation module, implemented according to an aspect of the invention and a speech recognition module.

In the speech recognition module, a feature extractor 201 extracts a feature vector of a signal source from a digital sound signal received through the inverse discrete Fourier transformer 107. The extracted feature vector is input to a pattern comparator 202. The pattern comparator 202 compares the extracted feature vector with patterns stored in a reference pattern storage unit to search for a sound similar to the input sound signal. The pattern comparator 202 searches for a pattern with a highest match score, i.e., a highest correlation, and transmits the correlation, i.e., the match score, to a determiner 204. The determiner 204 determines sound information corresponding to the searched pattern as being recognized when the match score exceeds a predetermined value.

Figure 4:
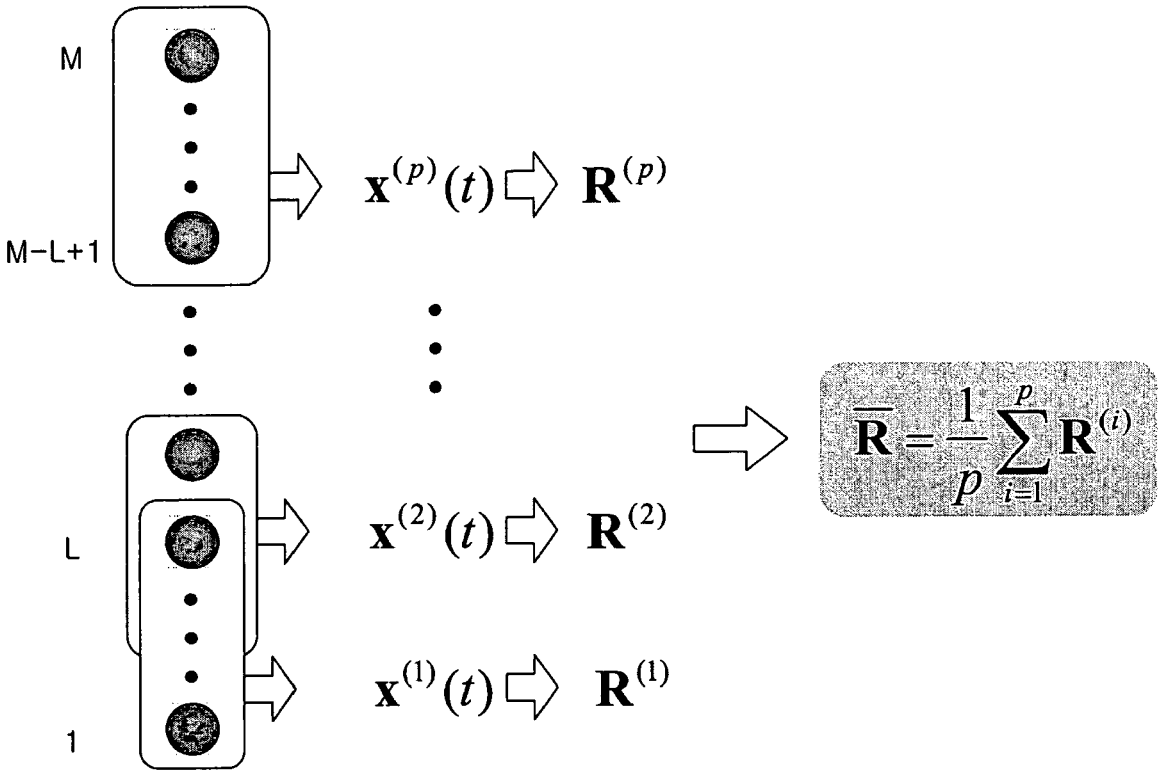
FIG. 4 illustrates a concept of spatial smoothing (SS) of a narrowband signal.

The concept of spatial smoothing (SS) will be described with reference to FIG. 4. The SS is a pre-process of producing a new spatial covariance matrix by averaging spatial covariance matrices of outputs of microphones of each sub-array on the assumption that an entire array is composed of a plurality of sub-arrays. The new spatial covariance matrix comprises a new signal source which does not have a correlation with a new directional matrix having the same characteristics as a directional matrix produced with respect to the entire array. Equation (8) defines "p" sub-arrays each of which includes L microphones arrayed at equal intervals in a total of M microphones.

$$\begin{aligned} x^{(1)}(t) &= [x_1(t) \ \dots \ x_L(t)]^T \\ x^{(2)}(t) &= [x_2(t) \ \dots \ x_{L+1}(t)]^T \\ &\vdots \\ x^{(p)}(t) &= [x_p(t) \ \dots \ x_{L+P-1}(t)]^T \end{aligned} \tag{8}$$

Here, an i-th sub-array input vector is given as Equation (9).

$$x^{(i)}(t)=BD^{(i-1)}s(t)+n^{(i)}(t) \tag{9}$$

Here, $D^{(i-1)}$ is given as Equation (10).

$$D^{(i-1)}=\mathrm{diag}(e^{-j\omega\theta\tau(\theta_1)}e^{-j\omega\theta\tau(\theta_2)} \dots e^{-j\omega\theta\tau(\theta_D)})^{i-1} \tag{10}$$

Here, $\tau(\theta_d)$ indicates a time delay between microphones with respect to a d-th signal source.

In addition, B is a directional matrix comprising L-dimensional sub-array directional vectors reduced from M-dimensional directional vectors of the entire equal-interval linear array and is given as Equation (11).

$$B=[\tilde{a}(\theta_1)\tilde{a}(\theta_2) \dots \tilde{a}(\theta_D)] \tag{11}$$

Here, $\tilde{a}(\theta_1)$ is given as Equation (12).

$$\tilde{a}(\theta_l) = \left[e^{-j\omega_0\frac{d\sin\theta}{c}} \ \dots \ e^{-j\omega_0(L-1)\frac{d\sin\theta}{c}}\right]^T \tag{12}$$

A calculation of obtaining spatial covariance matrices for the respective "p" sub-arrays and averaging the spatial covariance matrices is expressed as Equation (13), where "H" designates a conjugate transpose.

$$\begin{aligned} \overline{R} &= \frac{1}{p}\sum_{i=1}^{p} E\left[x^{(i)}(x^{(i)})^H\right] \\ &= B\left(\frac{1}{p}\sum_{i=1}^{p} D^{(i-1)}SD^{H(i-1)}\right)B^H + \sigma^2 I \\ &= B\overline{R}_{SS}B^H + \sigma^2 I \end{aligned} \tag{13}$$

Here, $\overline{R}_{ss}$ is given as Equation (14).

$$\overline{R}_{SS} = \frac{1}{p}\sum_{i=1}^{p} D^{(i-1)}R_{SS}D^{H(i-1)} \tag{14}$$

When $p \geqq D$, a rank of $\overline{R}_{SS}$ is D. When the rank of $\overline{R}_{SS}$ is D, a signal subspace has D dimensions and thus is orthogonal to other eigenvectors. As a result, a null is formed in a direction of an interference signal. To identify K coherent signals, K sub-arrays each of which comprises at least one more microphone more than the number of signal sources are required, and therefore, a total of at least 2K microphones are required.

Figure 5:
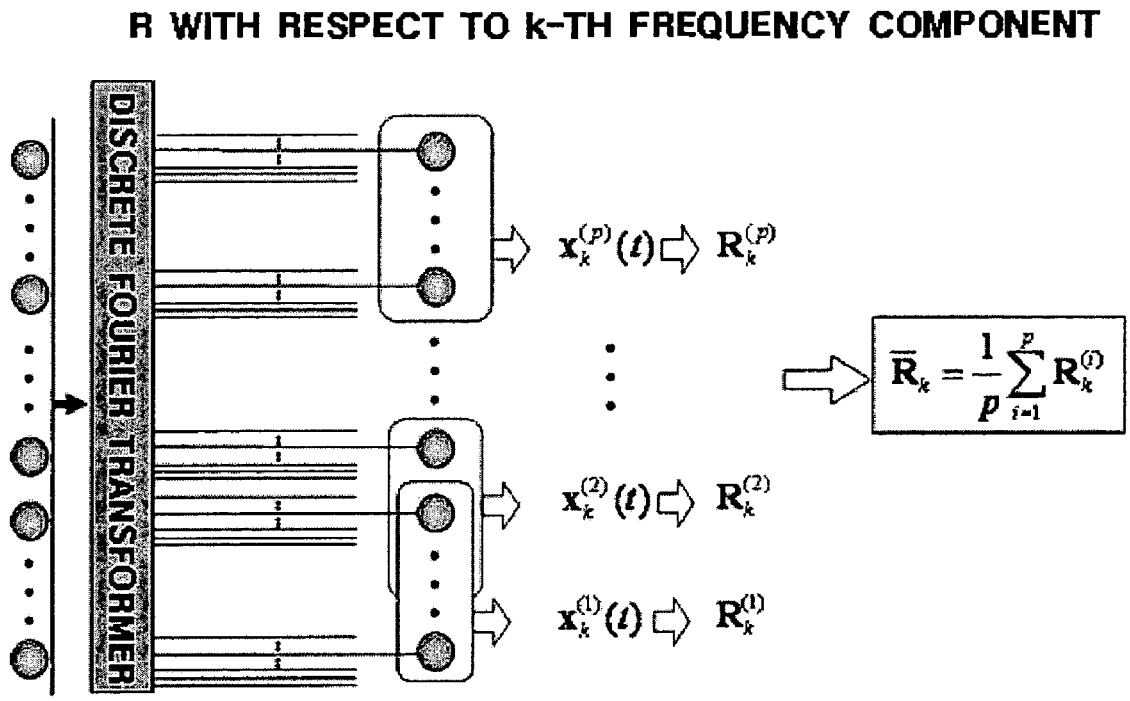
FIG. 5 illustrates a concept of wideband SS extending to a wideband signal source according to the invention.

Wideband SS according to the invention will be described with reference to FIG. 5. In the present invention, SS is extended so that it can be applied to wideband signal sources in order to solve an echo problem occurring in an actual environment. To implement wideband SS, a wideband input signal is preferably split into narrowband signals using DFT, and then SS is applied to each narrowband signal. With respect to "p" sub-arrays of microphones, input signals of one-dimensional sub-arrays of microphones at a k-th frequency component can be defined as Equation (15).

$$\begin{aligned} x_k^{(1)} &= [X_{1,k} \ \dots \ X_{L,k}]^T \\ x_k^{(2)} &= [X_{2,k} \ \dots \ X_{L+1,k}]^T \\ &\vdots \\ x_k^{(p)} &= [X_{p,k} \ \dots \ X_{L+p-1,k}]^T \end{aligned} \tag{15}$$

A calculation of obtaining spatial covariance matrices for the respective "p" sub-arrays of microphones and averaging the spatial covariance matrices is expressed as Equation (16).

$$\overline{R}_k = \frac{1}{p}\sum_{i=1}^{p} E\left[x_k^{(i)}(x_k^{(i)})^H\right. \tag{16}$$

Estimation of an incidence angle of a target signal source and beamforming can be performed using $\overline{R}_k$ and Equations (3) (4), and (7). The invention uses $\overline{R}_k$ to estimate an incidence angle of a target signal source and perform a beamforming method, thereby preventing performance from being deteriorated or diminished in an echoing environment.

Figure 6:
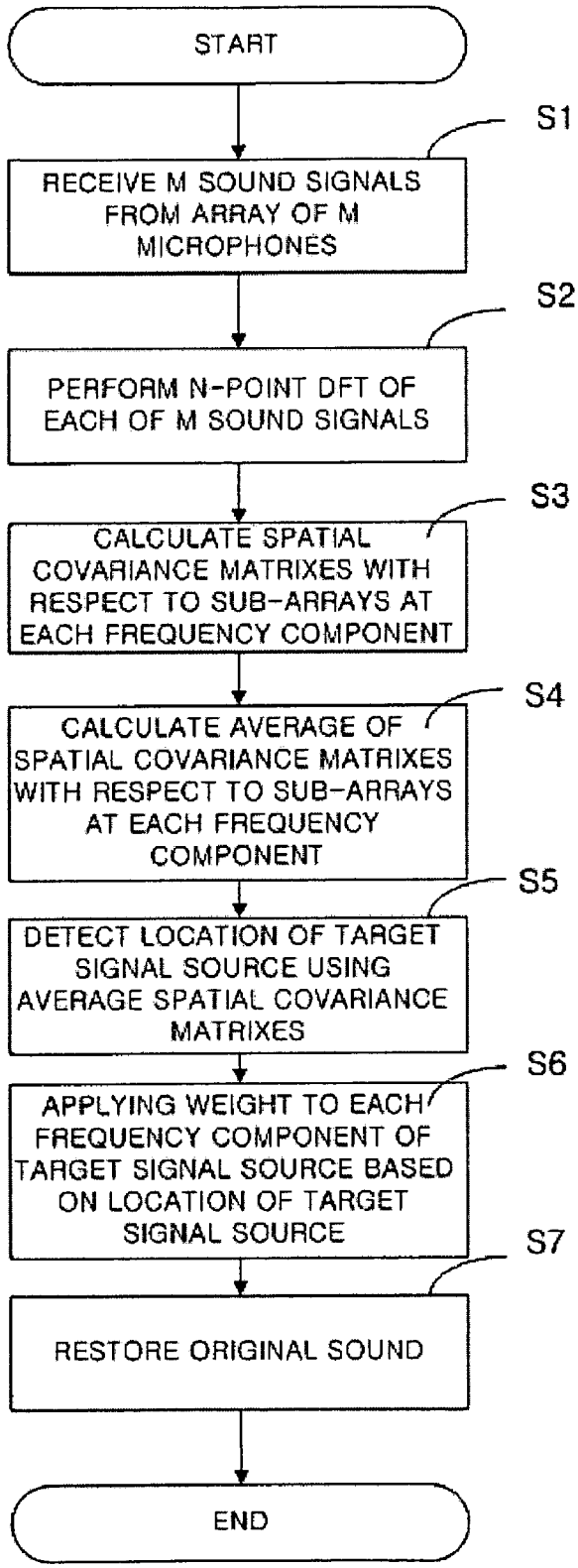
FIG. 6 is a flowchart of a method of compensating for distortion due to an echo according to an embodiment of the invention.

FIG. 6 is a flowchart of a method of compensating for a distortion due to an echo according to an aspect of the invention. M sound signals are received through an array of M microphones in operation S1. An N-point DFT is performed with respect to each of the M sound signals in operation S2. The DFT is performed to split a frequency of a wideband sound signal into N narrowband frequency components. Spatial covariance matrices are obtained at each narrowband frequency component. The spatial covariance matrices are not calculated with respect to all of the M sound signals, but they are calculated with respect to virtual sub-arrays, each of which includes L microphones, at each frequency component in operation S3. An average of the spatial covariance matrices with respect to the sub-arrays is calculated at each frequency component in operation S4. A location, i.e., an incidence angle, of a target signal source is detected using the average spatial covariance matrix obtained at each frequency component in operation S5. Preferably, a multiple signal classification (MUSIC) method is used to detect the location of the target signal source. In operation S6, upon detecting the location of the target signal source, a weight for compensating for signal distortion in each frequency component of the target signal source is calculated and multiplied by each frequency component based on the location of the target signal source. Preferably, a wideband MV method is used to apply weights to the target signal source. In operation S7, the weighted individual frequency components of the target signal source are combined to restore an original sound signal. Preferably, inverse DFT (IDFT) is used to restore the original sound signal.

Figure 7:
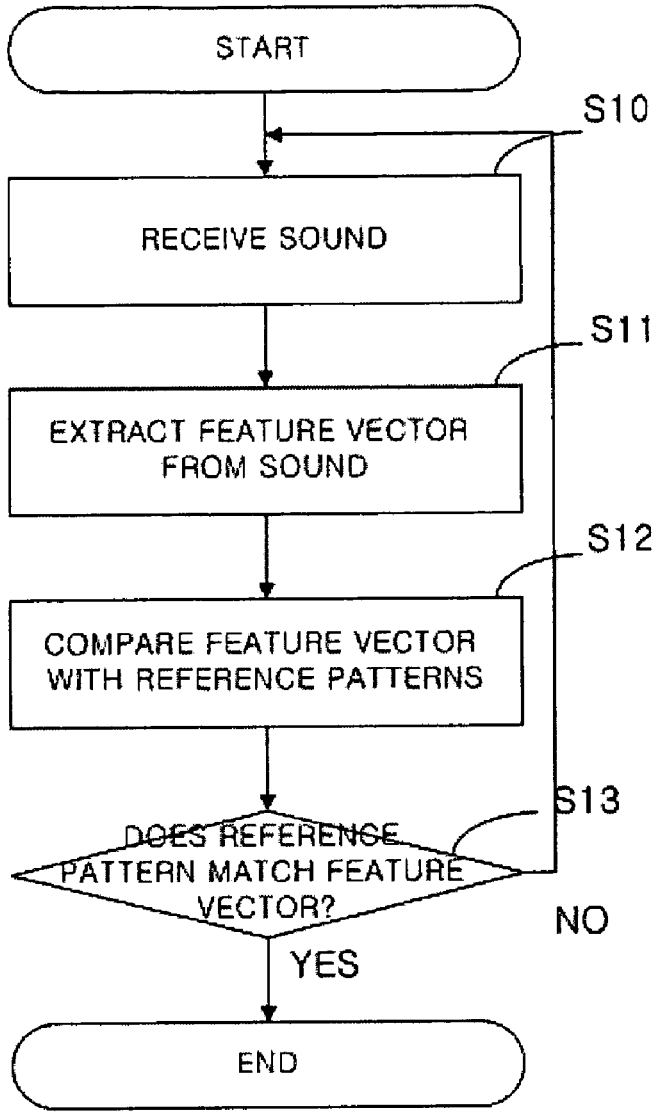
FIG. 7 is a flowchart of a speech recognition method according to an embodiment of the invention.

FIG. 7 is a flowchart of a speech recognition method according to an aspect of the invention. In operation S10, a sound signal, e.g., a human speech signal, which has been compensated for signal distortion due to an echo using the method illustrated in FIG. 6, is received. In operation S11, features are extracted from the sound signal, and a feature vector is generated based on the extracted features. In step operation, the feature vector is compared with reference patters stored in advance. In operation S13, when a correlation between the feature vector and a reference pattern exceeds a predetermined level, the matched reference pattern is output. Otherwise, a new sound signal is received and operations S11-13 are repeated.

Figure 8:
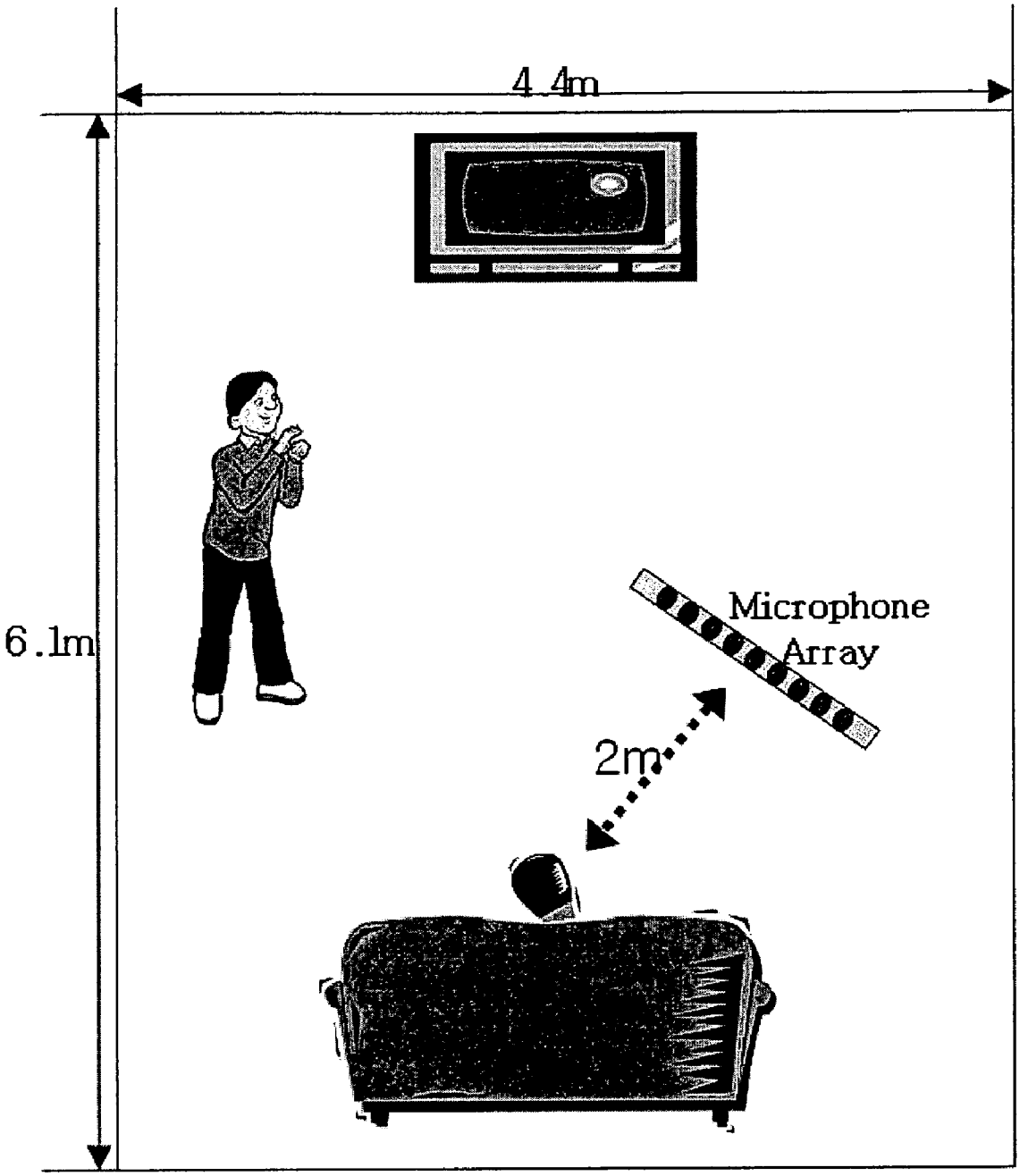
FIG. 8 illustrates an indoor environment in which experiments were made on a microphone array system according to an embodiment of the invention.
Figure 9:
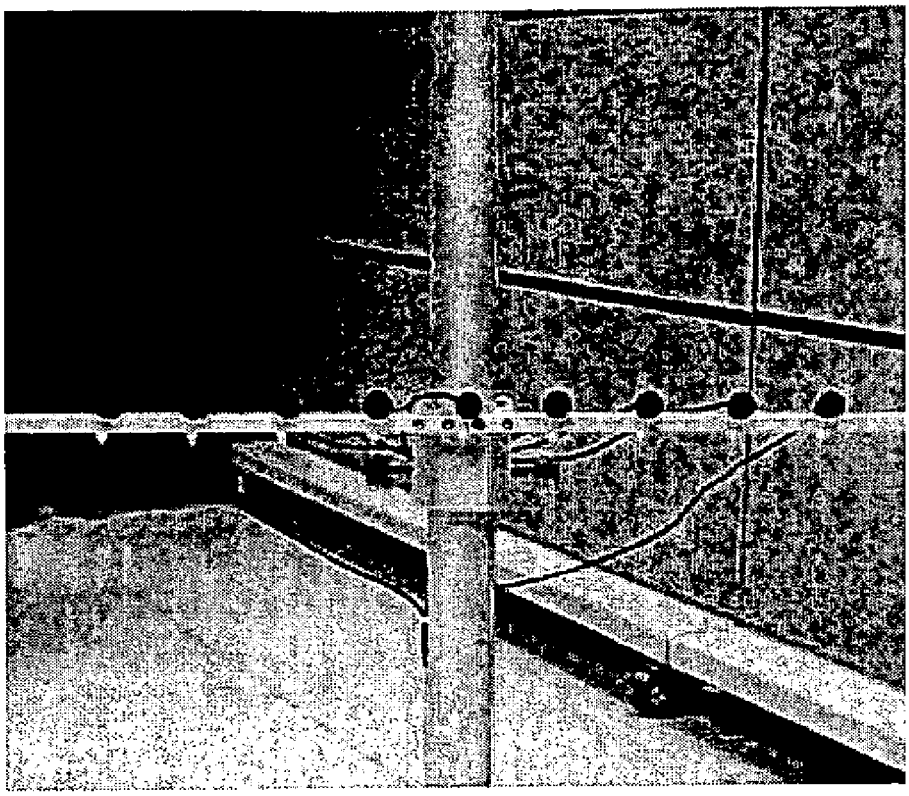
FIG. 9 shows a microphone array according to FIG. 8.

FIG. 8 illustrates an indoor environment in which experiments were conducted on a microphone array system according to an aspect of the invention. A room of several meters in length and width may contain a household appliance such as a television (TV), walls, and several persons. In such a space, a sound signal may be partially transmitted directly to a microphone array and partially transmitted to the microphone array after being reflected by things, walls, or persons. FIG. 9 shows a microphone array used in the experiments. In the experiments, the microphone array system was constructed using 9 microphones, however, the microphone array system is not limited to 9 microphones. Performance of SS provided to be suitable to sound signals according to the invention varies depending upon the number and quality of microphones used. For example, the number of microphones in a sub-array decreases, the number of sub-arrays increases so that removal of a target signal is reduced. However, a resolution is also reduced, thereby deteriorating performance of removing an interference signal. Accordingly, the number of microphones constituting a sub-array needs to be set appropriately. Table 1 shows results of testing the 9-microphone array system for Signal to Interface and Noise Ratios (SINRs) and speech recognition ratios according to the number of microphones in a sub-array.

TABLE 1

| Noise | Number of microphones in sub-array | SINR (dB) | Recognition Ratio (%) |
|---|---|---|---|
| Music | 9 | 1.1. | 60 |
| | 8 | 8.7 | 75 |
| | 7 | 12 | 82.5 |
| | 6 | 13 | 87.5 |
| | 5 | 11.1 | 87.5 |
| Pseudo noise (PN) | 9 | 3.2. | 77.5 |
| | 8 | 8.6 | 80 |
| | 7 | 11.9 | 85 |
| | 6 | 10.1 | 90 |
| | 5 | 8 | 87.5 |

Based on the results shown in Table 1, 6 was chosen as the optimal number of microphones in each sub-array. FIG. 10(A) shows a waveform of an output signal with respect to a reference signal in a conventional method. FIG. 10(B) shows a waveform of an output signal with respect to a reference signal in an embodiment of the present invention. In FIGS. 10(A) and 10(B), a waveform (1) corresponds to the reference signal, a waveform (2) corresponds to a signal input to a first microphone, and a waveform (3) corresponds to the output signal. As shown in FIGS. 10(A) and 10(B), attenuation of a target signal can be overcome in the invention.

Table 2 shows average speech recognition ratios obtained when the experiments were performed in various noises environments to compare the invention with conventional technology.

TABLE 2

| | Conventional technology | Present invention |
|---|---|---|
| Average speech recognition ratio | 68.8% | 88.8% |

While the performance of an entire system depends on the performance of a speech signal detector in conventional technology, stable performance is guaranteed regardless of existence or non-existence of a target signal by using SS in the invention. Meanwhile, the wideband MUSIC unit 105 shown in FIG. 2 performs a MUSIC algorithm with respect to all frequency bin, which places a heavy load on a system recognizing a direction of a speech signal. In other words, when a microphone array comprises M microphones, most computation for a narrowband MUSIC algorithm takes place in eigenvalue decomposition performed to find a noises subspace from M*M covariance matrices. Here, the amount of computation is proportional to triple the number of microphones. When an N-point DFT is performed, the amount of computation required for the wideband MUSIC algorithm can be expressed as $O(M^3)*N_{FFT}/2$. Accordingly, a method of decreasing the amount of computation required for the wideband MUSIC algorithm is desired to increase the entire system performance.

Figure 11:
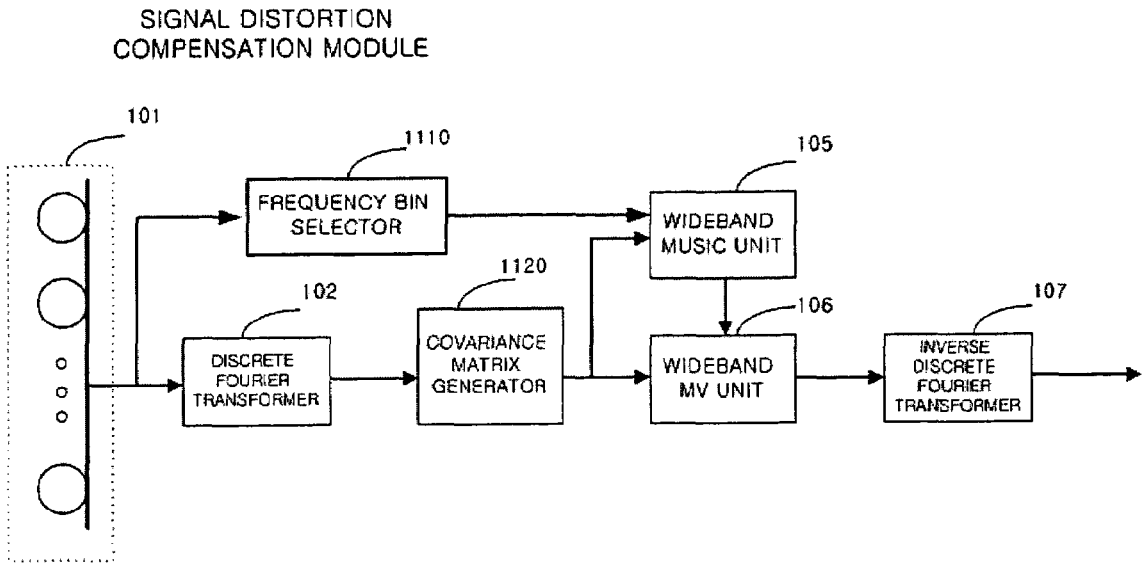
FIG. 11 is a block diagram of a microphone array system for decreasing the amount of computation required for a MUSIC algorithm according to an embodiment of the invention.

FIG. 11 is a block diagram of a microphone array system for decreasing the amount of computation required for a MUSIC algorithm, according to an aspect of the invention.

As described above, a MUSIC algorithm performed by the wideband MUSIC unit 105 is typically applied to all frequency bins, thereby causing a speech recognition system using the MUSIC algorithm to be overloaded in calculation. To overcome this problem, a frequency bin selector 1110 is added to a signal distortion compensation module, as shown in FIG. 11 in the embodiment of the present invention. The frequency bin selector 1110 selects frequency bins likely to contain a speech signal according to a predetermined reference from among signals received from a microphone array including a plurality of microphones so that the wideband MUSIC unit 105 performs the MUSIC algorithm with respect to only the selected frequency bins. As a result, the amount of computation required for the MUSIC algorithm is reduced and system performance is improved. In this aspect, a covariance matrix generator 1120 may be the spatial covariance matrix estimator 104 using the wideband SS, as shown in FIG. 2, or another type of logical block generating a covariance matrix. The discrete Fourier transformer 102, as shown in FIG. 2, may perform a fast Fourier Transform (FFT).

Figure 12:
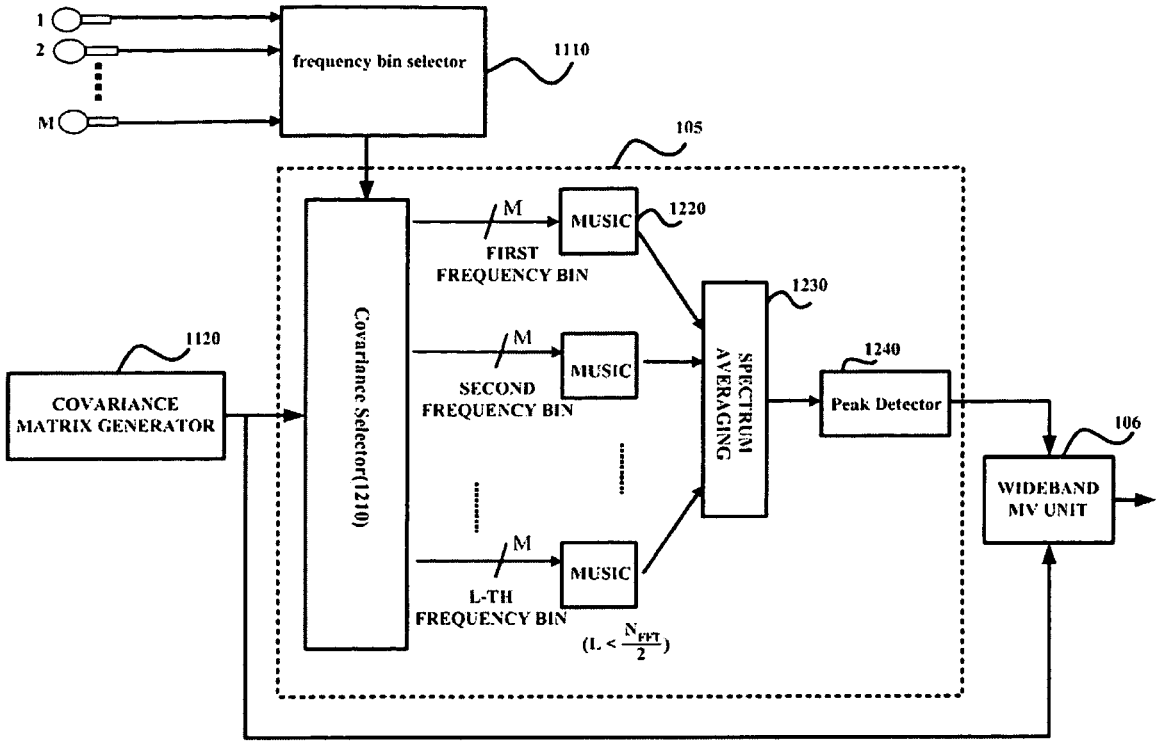
FIG. 12 is a logical block diagram of a wideband MUSIC unit according to an embodiment of the invention.

FIG. 12 is a logical block diagram of the wideband MUSIC unit 105 according to an embodiment of the present invention. As shown in FIG. 12, a covariance selector 1210 included in the wideband MUSIC unit 105 only selects covariance matrix information from the covariance matrix generator 1120 and the covariance matrix information corresponding to a frequency bin selected by the frequency bin selector 1110. Accordingly, when an NFFT-point DFT is performed, $N_{FFT/2}$ frequency bins may be generated. A MUSIC algorithm is not performed with respect to all of the $N_{FFT/2}$ frequency bins generated by the covariance selector 1210 but is only performed with respect to L frequency bins 1220 selected by the frequency bin selector 1110. Accordingly, the amount of computation required for the MUSIC algorithm is reduced from $O(M^3)*N_{FFT}/2$ to $O(M^3)*L$. The MUSIC algorithm results undergo spectrum averaging 1230, and then a direction of a speech signal is obtained by a peak detector 1240. Here, the spectrum averaging and the peak detection are performed using a conventional MUSIC algorithm.

Figure 13:
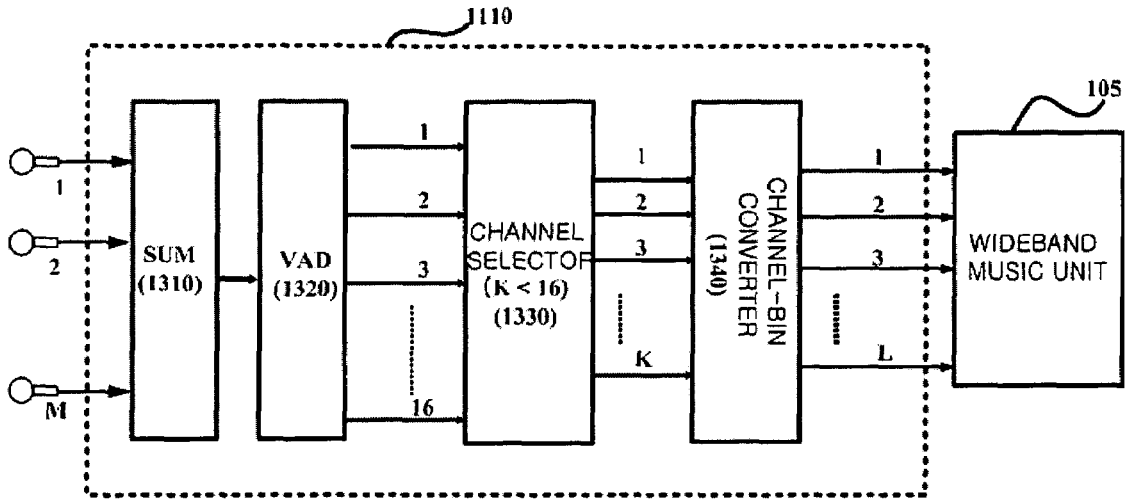
FIG. 13 is a block diagram of a logical structure for selecting frequency bins according to an embodiment of the invention.

FIG. 13 is a block diagram of a logical structure for selecting frequency bins according to an aspect of the invention. FIG. 13 illustrates the frequency bin selector 1110 shown in FIG. 11. In this embodiment, the number of frequency bins is determined according to the number of selected channels. Signals received from a microphone array including M microphones are summed (1310). A voice activity detector (VAD) 1320 using a conventional technique detects a speech signal from the sum of the signals and outputs a speech presence probability (SPP) with respect to each channel. Here, the channel is a unit into which a predetermined number of frequency bins are grouped. In other words, since speech signal power tends to decrease as the frequency of the speech signal increases, the speech signal is processed in units of channels not in units of frequency bins. Accordingly, as the frequency of the speech signal increases, the number of frequency bins constituting a single channel also increases.

Figure 14:
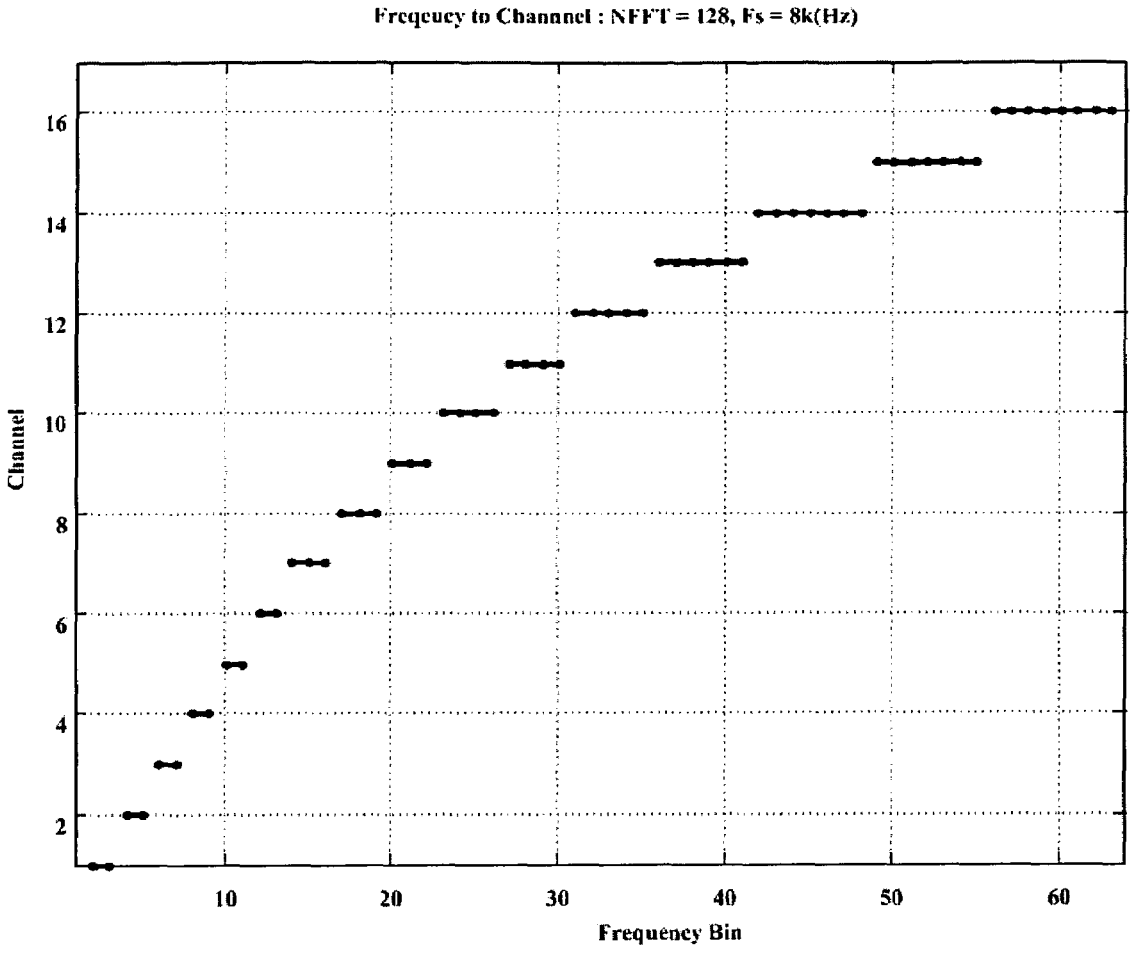
FIG. 14 illustrates a relationship between a channel and a frequency bin according to an embodiment of the invention.

FIG. 14 illustrates a relationship between a channel and a frequency bin which are used by the VAD 1320, according to an aspect of the invention. In a graph shown in FIG. 14, the horizontal axis indicates the frequency bin and the vertical axis indicates the channel. In this aspect, 128-point DFT is performed and 64 frequency bins are generated. However, actually, 62 frequency bins are used because a first frequency bin corresponding to a direct current component and a second frequency bin corresponding to a very low frequency component are excluded.

As shown in FIG. 14, more frequency bins are included in a channel for a higher frequency component. For example, a 6th channel includes 2 frequency bins, but a 16th channel includes 8 frequency bins.

In the embodiment of the present invention, since 16 channels are defined, the VAD 1320 outputs 16 SPPs for the respective 16 channels. Thereafter, a channel selector 1330 lines up the 16 SPPs and selects K channels having highest SPPs and transmits the K channels to a channel-bin converter 1340. The channel-bin converter 1340 converts the K channels into frequency bins. The covariance selector 1210, included in the wideband MUSIC unit 105 shown in FIG. 12, selects only the frequency bins into which the K channels have been converted.

For example, let's assume that 5th and 10th channels shown in FIG. 14 have the highest SPPs. In this situation, when the channel selector 1330 selects only two channels having the highest SPPs, i.e., K=2, the MUSIC algorithm is performed with respect to only 6 frequency bins.

Figure 15A:
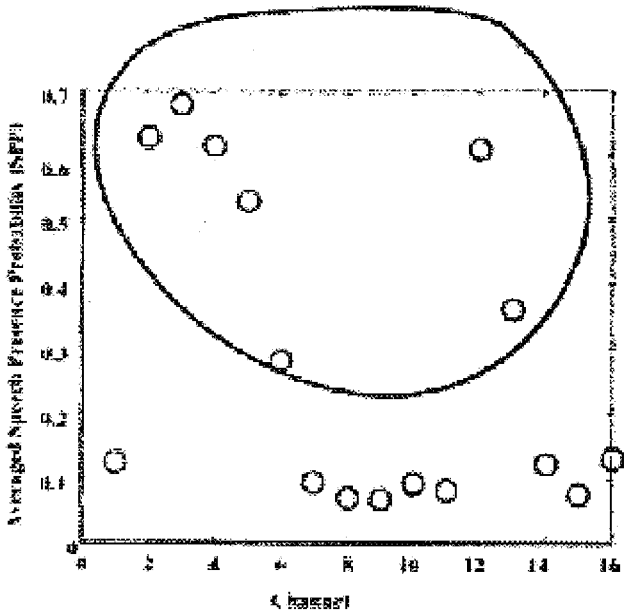
FIGS. 15(A)-(C) illustrates a distribution of averaged speech presence probabilities (SPPs) with respect to individual channels according to an embodiment of the present invention.
Figure 15B:
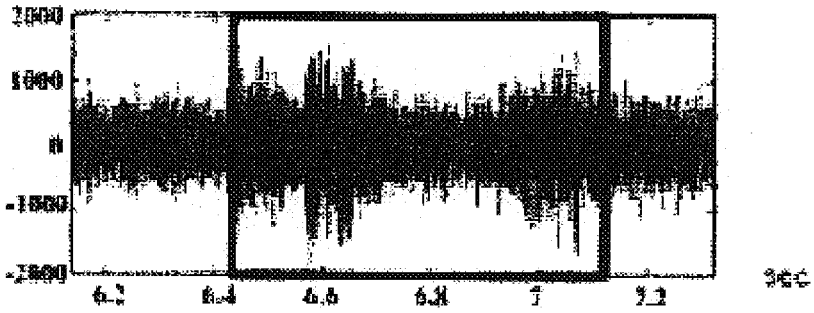
Figure 15C:
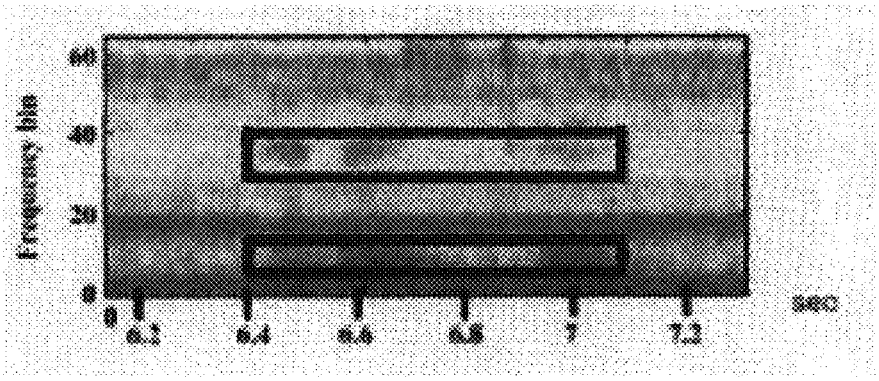

FIG. 15(B) shows variation in magnitude of a signal over time. Here, a sampling frequency is 8 kHz, and a measured signal is expressed as magnitudes of 16-bit sampling values. FIG. 15(C) is a spectrogram. Referring to FIG. 14, frequency bins included in the 6 selected channels correspond to squares in the spectrogram shown in FIG. 15(C), where more speech signal is present than noise signal.

Figure 16:
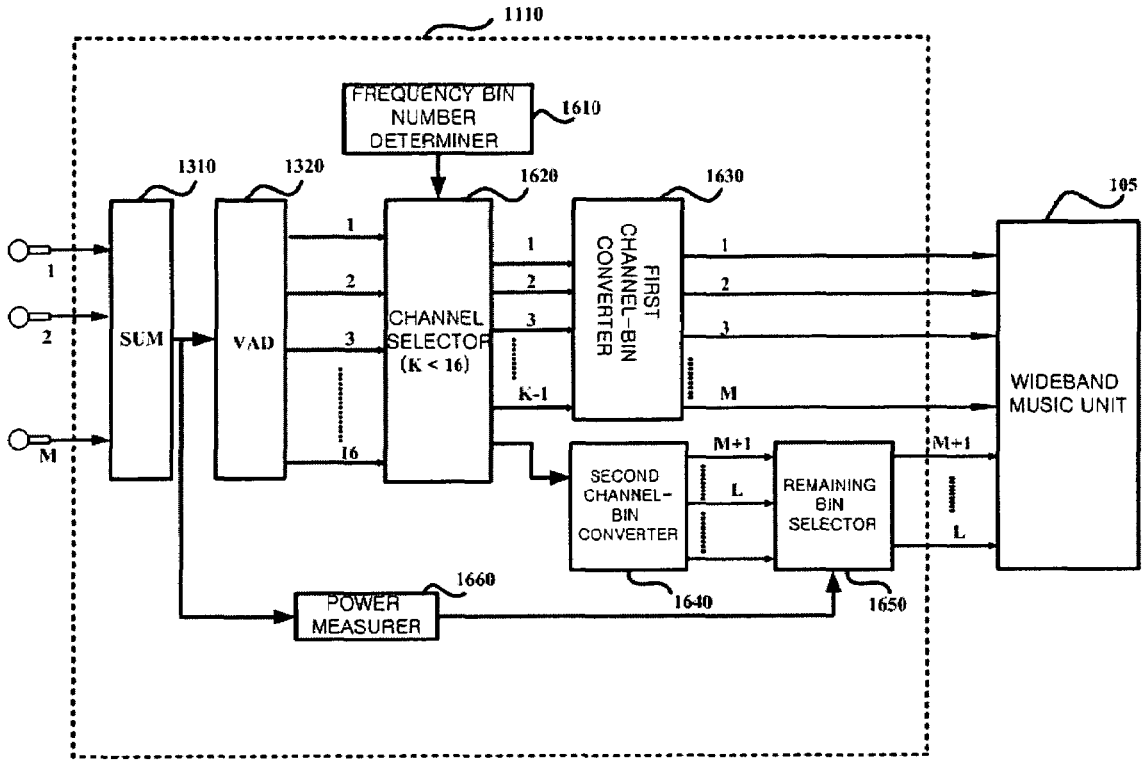
FIG. 16 is a block diagram of a logical structure for selecting frequency bins according to another embodiment of the present invention.

FIG. 16 is a block diagram of a logical structure for selecting frequency bins according to another of the invention. Unlike the embodiment shown in FIG. 13, the number of frequency bins is directly selected.

Since channels include different numbers of frequency bins as shown in FIG. 14, even if the number of channels to be selected as having highest SPPs is fixed as K, the number of frequency bins subjected to a MUSIC algorithm is variable. Accordingly, maintaining the number of frequency bins subject to the MUSIC algorithm constant is desired and a block diagram for doing so is illustrated in FIG. 16.

Referring to FIG. 16, when a frequency bin number determiner 1610 determines to select L frequency from bins, a channel selector 1620 detects K-th channel including an L-th frequency bin among channels lined up in descending order of SPP. Among the lined-up channels, first through (K−1)-th channels are converted into M frequency bins by a first channel-bin converter 1630, and then the converted M frequency bins are selected by the covariance selector 1210 included in the wideband MUSIC unit 105.

Meanwhile, it is necessary to select (L-M) frequency bins from the K-th channel including the L-th frequency bin. The (L-M) frequency bins may be selected in descending order of power. More specifically, a second channel-bin converter 1640 converts the K-th channel into frequency bins. Then, a remaining bin selector 1650 selects (L-M) frequency bins in descending order of power from among the converted frequency bins so that the covariance selector 1210 included in the wideband MUSIC unit 105 additionally selects the converted (L-M) frequency bins and performs the MUSIC algorithm thereon. Here, a power measurer 1660 measures power of signals input to the VAD 1320 with respect to each frequency bin and transmits measurement results to the remaining bin selector 1650 so that the remaining bin selector 1650 can select the (L-M) frequency bins in descending order of power.

Figure 17:
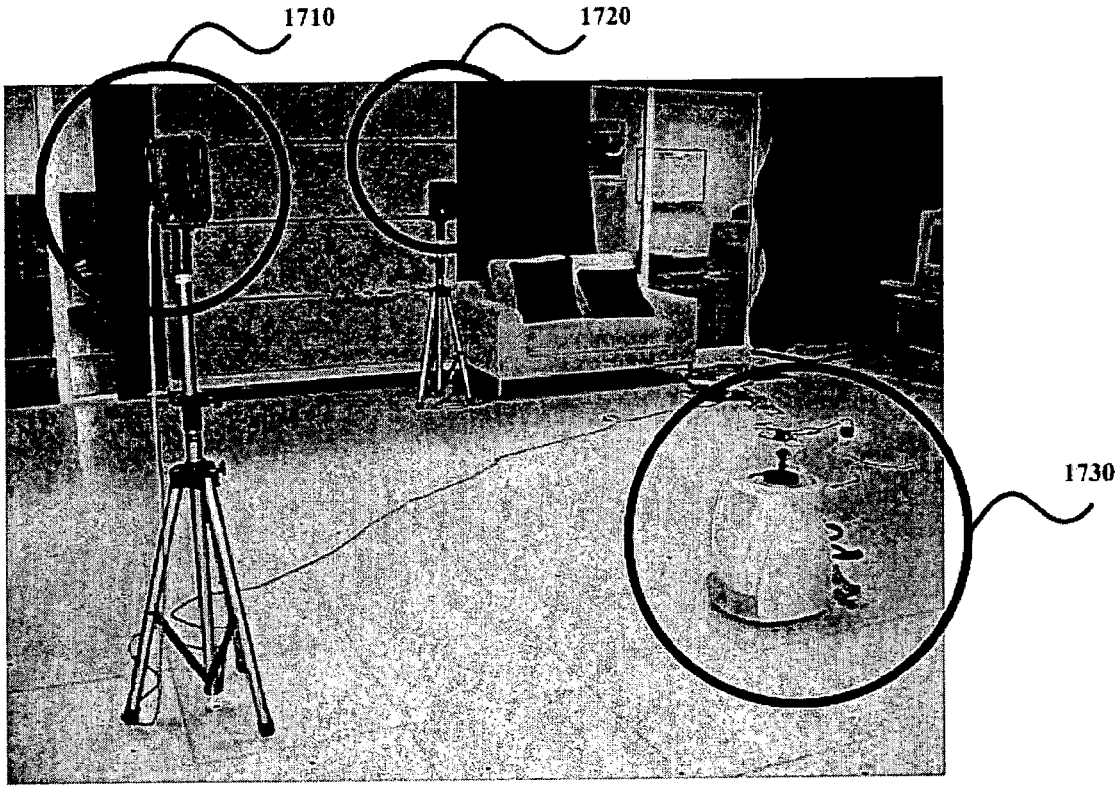
FIG. 17 shows an experimental environment for an embodiment of the invention.

FIG. 17 shows an example of an experimental environment used for testing embodiments of the invention. The experiment environment includes a speech speaker 1710, a noise speaker 1720, and a robot 1730 processing signals. The speech speaker 1710 and the noise speaker 1720 were initially positioned to make a right angle with respect to the robot 1730. Fan noise was used, and a signal-to-noise ratio (SNR) was changed from 12.54 dB to 5.88 dB and 1.33dB. The noise speaker 1720 was positioned at a distance of 4 m and in a direction of 270 degrees from the robot 1730. The speech speaker 1710 was sequentially positioned at distances of 1, 2, 3, 4, and 5 m from the robot 1730, and measurement was performed when the speech speaker 1710 had directions of 0, 45, 90, 135, and 180 degrees from the robot 1730 at each distance. However, due to a limitation of the experiment environment, measurement was performed only in 45 and 135 degrees when the speech speaker 1710 was positioned at a distance of 5 m from the robot 1730.

Figure 18:
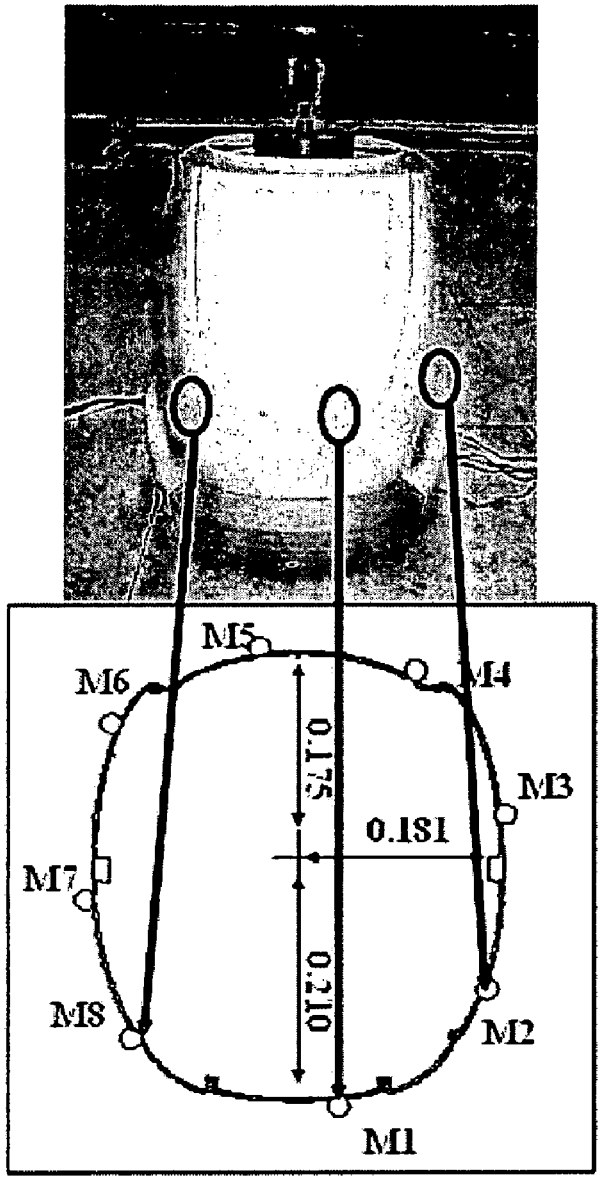
FIG. 18 illustrates a microphone array structure used in experiments.

FIG. 18 illustrates an example of a microphone array structure used in experiments. 8 microphones were used and were attached to the robot 1730. In the experiments, 6 channels having highest SPPs were selected for a MUSIC algorithm. Referring to FIG. 15, the 2nd through 6th, 12th, and 13th channels were selected, and 21 frequency bins included in the selected channels among a total of 62 frequency bins were subjected to the MUSIC algorithm.

In the experimental environment shown in FIGS. 17 and 18, the results of testing embodiments for recognition of speech direction are shown in the following tables. In a conventional method, all of frequency bins were subjected to the MUSIC algorithm. In the tables, a case going beyond an error threshold is marked with an underline.

(1) SNR=12.54 dB (Error Bound: ±5 Degrees)

(i) Conventional Method

TABLE 3

| | 1 m | 2 m | 3 m | 4 m | 5 m |
|---|---|---|---|---|---|
| 0 | 0/0/0/0 | 0/0/0/0 | 0/0/0/0 | 0/0/0/0 | |
| degrees | 0/0/0/0 | 0/0/0/0 | 0/0/0/0 | 0/0/0/0 | |
| 45 | 50/50/50/50 | 45/45/45/45 | 45/45/45/45 | 45/45/45/45 | 45/45/45/45 |
| degrees | 50/50/50/50 | 45/45/45/45 | 45/45/45/45 | 45/45/45/45 | 45/45/45/40 |
| 90 | 90/90/85/85 | 90/90/90/90 | 90/90/90/90 | 90/90/90/90 | |
| degrees | 90/90/90/90 | 90/90/90/90 | 90/90/90/90 | 90/90/90/90 | |
| 135 | 135/135/135/135 | 135/135/135/135 | 135/135/135/135 | 135/135/135/135 | 135/135/135/135 |
| degrees | 135/135/135/135 | 135/135/135/135 | 135/135/135/135 | 135/135/135/135 | 135/135/135/135 |
| 180 | 180/180/180/180 | 180/180/180/180 | 180/180/180/180 | 180/180/185/180 | |
| degrees | 180/180/180/180 | 180/180/180/180 | 180/180/180/180 | 180/180/180/180 | |

(ii) Aspect of the Invention (the Amount of Computation Decreased by 70.0%)

TABLE 4

| | 1 m | 2 m | 3 m | 4 m | 5 m |
|---|---|---|---|---|---|
| 0 | 0/0/0/0 | 355/355/355/0 | 0/0/0/0 | 0/0/0/0 | |
| degrees | 0/0/0/0 | 0/0/0/0 | 0/0/0/0 | 0/0/0/0 | |
| 45 | 45/45/45/40 | 40/40/40/40 | 45/45/45/40 | 45/40/40/45 | 45/45/45/45 |
| degrees | 45/45/45/45 | 40/40/40/40 | 40/45/45/45 | 45/45/45/45 | 45/45/45/40 |
| 90 | 95/95/85/80 | 90/90/90/90 | 90/90/90/90 | 90/90/90/90 | |
| degrees | 90/90/90/90 | 90/90/90/90 | 90/90/90/90 | 90/90/90/90 | |
| 135 | 140/140/140/140 | 135/135/135/135 | 135/140/140/140 | 140/140/140/140 | 140/140/140/140 |
| degrees | 140/140/140/140 | 135/135/135/135 | 140/140/140/140 | 140/140/140/140 | 140/140/140/140 |
| 180 | 180/180/180/180 | 180/180/180/180 | 180/180/180/180 | 180/180/190/180 | |
| degrees | 185/185/170/185 | 180/180/180/180 | 180/180/180/180 | 180/185/180/180 | |

(2) SNR=5.88 dB (Error Bound: ±5 Degrees)

(i) Conventional Method

TABLE 5

| | 1 m | 2 m | 3 m | 4 m | 5 m |
|---|---|---|---|---|---|
| 0 | 0/0/0/0 | 0/0/0/0 | 0/0/0/0 | 0/0/0/0 | |
| degrees | 340/0/0/0 | 0/0/0/0 | 0/0/0/0 | 0/0/0/0 | |
| 45 | 45/45/45/45 | 45/45/45/45 | 45/45/45/45 | 45/45/45/45 | 45/45/45/45 |
| degrees | 50/45/45/50 | 50/50/45/45 | 45/45/45/45 | 45/45/45/45 | 45/45/45/45 |
| 90 | 90/90/90/90 | 90/90/90/90 | 90/90/90/90 | 90/90/90/90 | |
| degrees | 90/90/90/85 | 90/90/90/90 | 90/90/90/90 | 90/90/90/90 | |
| 135 | 135/135/135/135 | 135/135/135/135 | 135/135/135/135 | 135/135/135/135 | 135/135/135/135 |
| degrees | 135/135/135/135 | 135/135/135/135 | 135/135/135/135 | 135/135/135/135 | 135/135/135/135 |
| 180 | 180/180/180/180 | 180/180/180/180 | 180/180/180/180 | 180/180/185/180 | |
| degrees | 180/180/180/180 | 180/180/180/180 | 180/180/180/180 | 180/180/185/180 | |

(ii) Aspect of the Invention (the Amount of Computation Decreased by 63.5%)

TABLE 6

| | 1 m | 2 m | 3 m | 4 m | 5 m |
|---|---|---|---|---|---|
| 0 | 0/0/0/0 | 0/355/0/0 | 0/0/0/0 | 0/0/0/0 | |
| degrees | 345/0/0/0 | 0/0/0/0 | 0/0/0/0 | 0/0/0/0 | |
| 45 | 45/45/45/40 | 40/40/45/40 | 40/40/40/40 | 45/45/45/45 | 45/45/40/45 |
| degrees | 45/45/45/45 | 45/45/45/40 | 40/45/45/45 | 45/45/45/50 | 45/45/45/45 |
| 90 | 90/90/90/90 | 90/90/90/90 | 90/90/90/90 | 90/90/90/90 | |
| degrees | 90/90/90/75 | 90/90/90/90 | 90/90/90/90 | 90/90/90/90 | |
| 135 | 140/140/140/140 | 135/135/135/135 | 135/135/135/135 | 140/140/140/140 | 140/135/135/135 |
| degrees | 140/140/140/140 | 135/135/135/135 | 135/140/135/140 | 140/140/140/140 | 135/135/135/135 |
| 180 | 180/185/180/180 | 180/180/180/180 | 180/180/180/180 | 180/180/180/180 | |
| degrees | 180/185/180/180 | 180/180/180/180 | 180/180/180/180 | 180/180/180/180 | |

(3) SNR=1.33 dB (Error Bound: ±5 Degrees)

(i) Conventional Method

TABLE 7

| | 1 m | 2 m | 3 m | 4 m | 5 m |
|---|---|---|---|---|---|
| 0 | 0/0/0/0 | 0/0/0/0 | 0/0/0/0 | 0/0/0/0 | |
| degrees | 0/0/0/0 | 0/0/0/0 | 0/0/0/0 | 0/0/0/0 | |
| 45 | 45/45/45/45 | 45/45/45/45 | 45/45/45/45 | 45/45/45/45 | 45/45/45/45 |
| degrees | 45/45/45/40 | 45/45/45/45 | 45/45/45/45 | 45/45/45/40 | 45/45/45/45 |
| 90 | 90/90/90/90 | 90/90/90/90 | 90/90/90/90 | 90/90/90/90 | |
| degrees | 90/90/90/90 | 90/90/90/90 | 90/90/90/90 | 90/90/90/90 | |
| 135 | 135/135/135/135 | 135/135/135/135 | 135/135/140/135 | 135/135/135/135 | 135/135/135/130 |
| degrees | 135/135/135/140 | 135/135/135/135 | 135/135/135/135 | 135/135/135/135 | 135/135/135/135 |
| 180 | 180/180/180/180 | 180/180/180/180 | 180/180/180/180 | 180/180/185/180 | |
| degrees | 180/180/180/180 | 180/180/180/180 | 180/180/180/180 | 180/180/180/180 | |

(ii) Aspect of the Invention

TABLE 8

| | 1 m | 2 m | 3 m | 4 m | 5 m |
|---|---|---|---|---|---|
| 0 | 0/0/0/0 | 0/0/0/0 | 0/0/0/0 | 0/0/0/0 | |
| degrees | 0/0/0/0 | 0/0/0/0 | 0/0/0/0 | 0/0/0/0 | |
| 45 | 45/45/45/40 | 40/40/40/40 | 45/45/40/40 | 45/45/45/45 | 45/45/45/45 |
| degrees | 40/45/40/45 | 40/45/45/40 | 45/45/45/40 | 45/45/45/45 | 45/45/45/45 |
| 90 | 90/90/90/90 | 90/90/90/90 | 90/90/90/90 | 90/90/90/90 | |
| degrees | 90/90/95/95 | 90/90/90/90 | 90/90/90/90 | 90/90/90/90 | |
| 135 | 140/140/140/140 | 135/135/135/135 | 135/135/130/135 | 140/135/140/140 | 135/135/135/135 |
| degrees | 140/140/140/140 | 135/135/135/135 | 135/140/135/140 | 140/135/140/140 | 135/135/135/135 |
| 180 | 185/185/185/185 | 185/185/185/185 | 185/185/185/185 | 185/185/185/185 | |
| degrees | 185/185/185/185 | 185/185/185/185 | 185/185/185/185 | 185/185/185/185 | |

When the results of experiments (1) through (3) are analyzed, an entire amount of computation decreases by approximately 66% in the invention. This average decreasing ratio is almost the same as a ratio at which the number of frequency bins subjected to the MUSIC algorithm decreases. As the amount of computation decreases, a success ratio in detecting a direction of the speech speaker 1710 may also decrease. This is shown in Table 9. However, it can be seen from Table 9 that a decrease in the success ratio is minimal.

TABLE 9

| | Conventional method | Present invention | Variation |
|---|---|---|---|
| 12.54 dB | 100.0(%) | 98.3(%) | −1.7 |
| 5.88 dB | 99.4(%) | 98.9(%) | −0.5 |
| 1.33 dB | 100.0(%) | 100.0(%) | 0.0 |

Figure 19A:
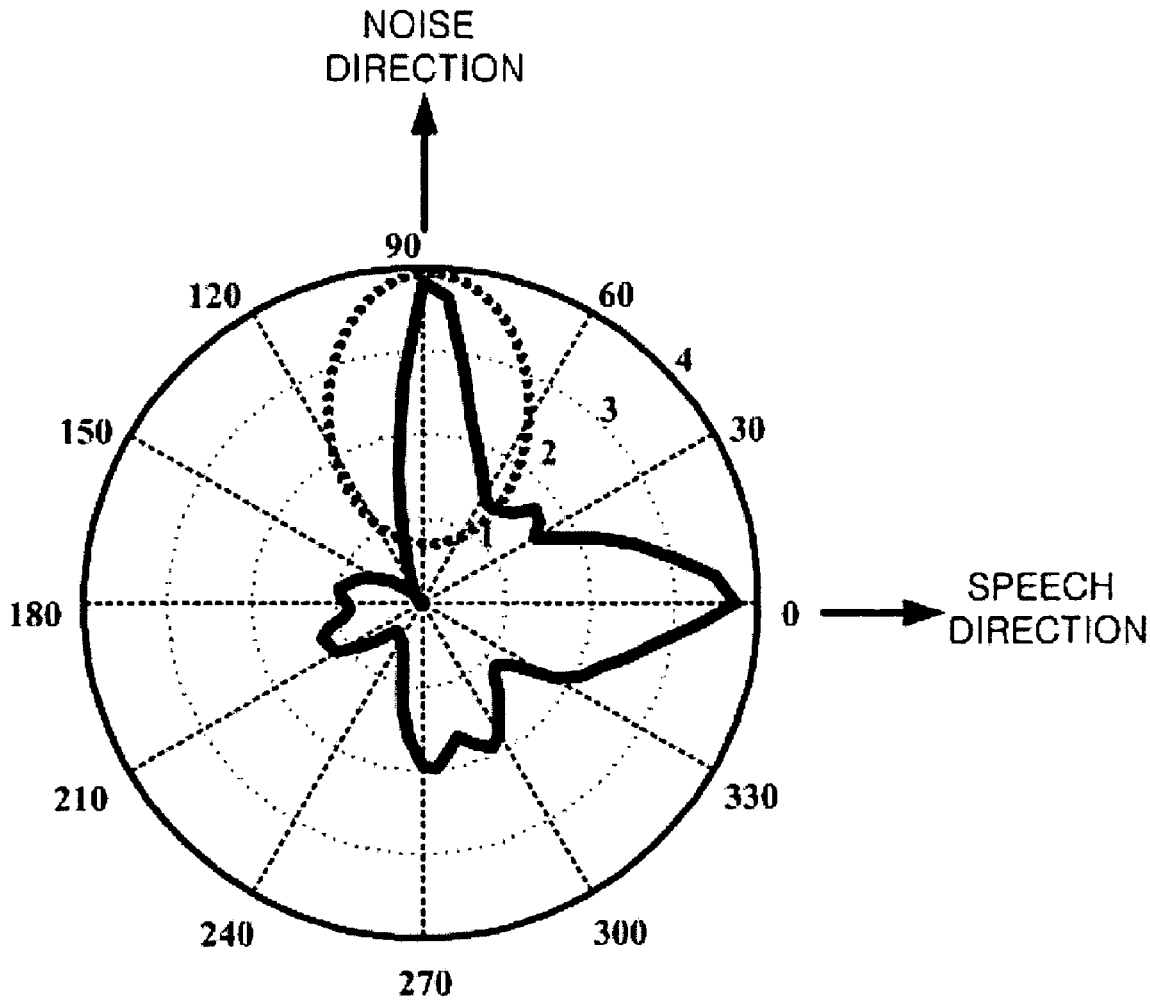
FIGS. 19A and 19B illustrate an improved spectrum in a noise direction according to an embodiment of the invention.
Figure 19B:
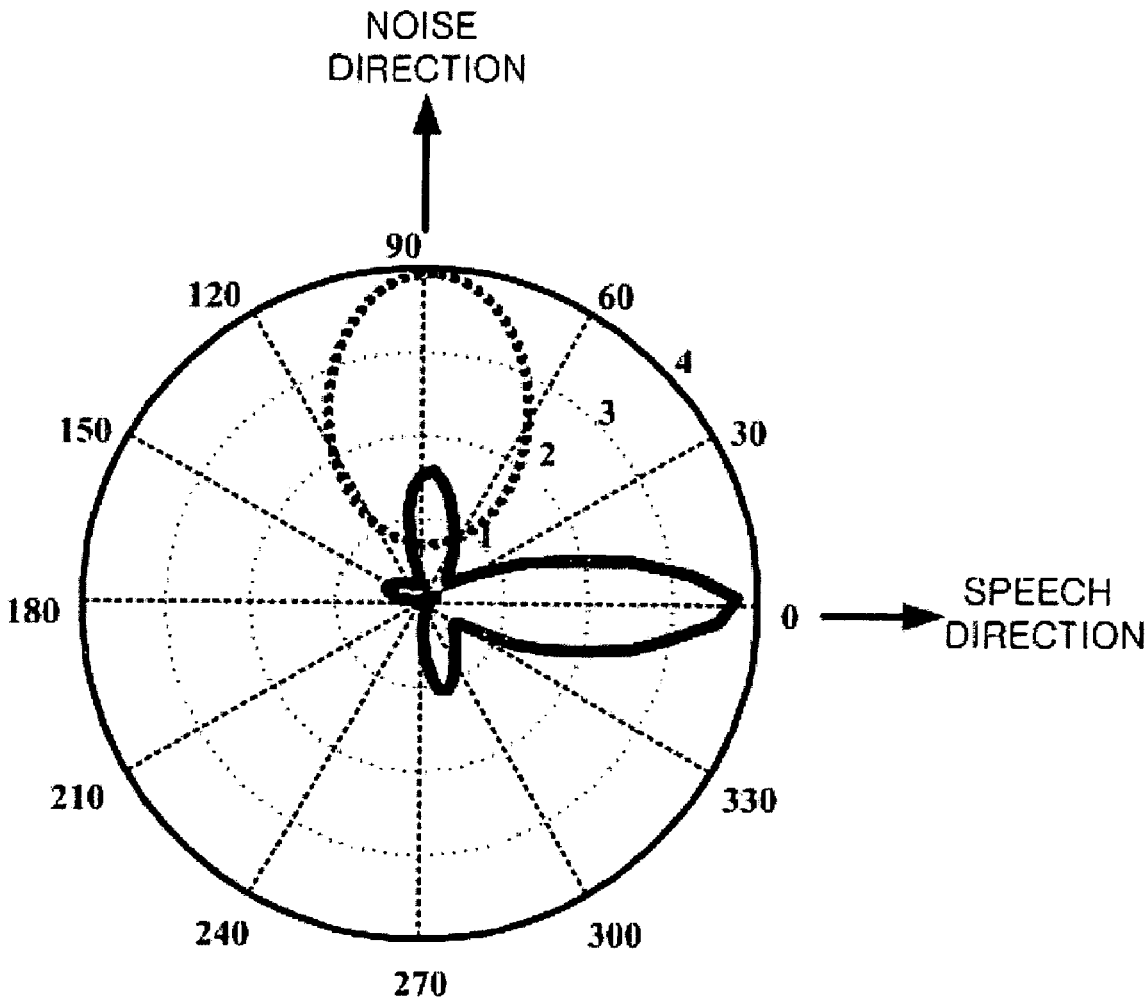

FIGS. 19A and 19B illustrate an improved spectrum in a noise direction according to an aspect of the invention. FIG.

19A shows a spectrum indicating a result of performing the MUSIC algorithm with respect to all frequency bins according to a conventional method. FIG. 19B shows a spectrum indicating a result of performing the MUSIC algorithm with respect to only selected frequency bins according to an embodiment of the present invention. As shown in FIG. 19A, when all of the frequency bins are used, a large spectrum appears in the noise direction. However, as shown in FIG. 19B, when only frequency bins selected based on SPPs are used according to an aspect of the invention, the spectrum in the noise direction can be greatly reduced. In other words, when a predetermined number of channels are selected based on SPPS, the amount of computation required for the MUSIC algorithm can be reduced, and the spectrum can also be improved.

According to the present invention, since removal of a wideband target signal is reduced in a location, for example, in an indoor environment, where an echo occurs, the target signal can be optimally acquired. A speech recognition system of the present invention uses a microphone array system that reduces the removal of the target signal, thereby achieving a high speech recognition ratio. In addition, since the amount of computation required for a wideband MUSIC algorithm is decreased, performance of the microphone array system can be increased.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A microphone array system comprising:

an input unit to receive sound signals using a plurality of microphones;

a frequency splitter to split each sound signal received through the input unit into a plurality of narrowband signals;

an average spatial covariance matrix estimator which uses spatial smoothing to obtain a spatial covariance matrix for each frequency component of the sound signal, by which spatial covariance matrices for a plurality of virtual sub-arrays, which are configured in the plurality of microphones, are obtained with respect to each frequency component of the sound signal processed by the frequency splitter and an average spatial covariance matrix is calculated;

a signal source location detector to detect an incidence angle of the sound signal according to the average spatial covariance matrix calculated using the spatial smoothing;

a signal distortion compensator to calculate a weight for each frequency component of the sound signal based on the incidence angle of the sound signal and multiply the calculated weight by each frequency component, thereby compensating for distortion of each frequency component; and a signal restoring unit to restore a sound signal using the distortion compensated frequency components, wherein the spatial smoothing is performed according to an equation $$\overline{R}_k = \frac{1}{p}\sum_{i=1}^{p} E\left[x_k^{(i)}(x_k^{(i)})^H\right],$$

where "p" indicates a number of the virtual sub-arrays, $x_k^{(i)}$ indicates a vector of an i-th sub-array microphone input signal, "k" indicates a k-th frequency component in a narrowband, and $\overline{R}_k$ indicates an average spatial covariance matrix.

2. The microphone array system of claim 1, wherein the frequency splitter uses discrete Fourier transform to split each sound signal into the plurality of narrowband signals, and the signal restoring unit uses inverse discrete Fourier transform to restore the sound signal.

3. The microphone array system of claim 1, wherein the incidence angle $\theta_1$ of the sound signal is calculated using the $\overline{R}_k$ and a multiple signal classification (MUSIC) algorithm, and the calculated incidence angle is applied to $$W_k = \frac{\overline{R}_k^{-1} a_k(\theta_1)}{a_k^H(\theta_1)\overline{R}_k^{-1} a_k(\theta_1)}$$

to calculate a weight to be multiplied by each frequency component of the sound signal.

4. The microphone array system of claim 1, wherein the signal source location detector splits each sound signal received from the input unit into the frequency components, into which the frequency splitter splits the sound signal, and performs a multiple signal classification algorithm only to frequency components selected according to a predetermined reference from among the split frequency components, thereby determining the incidence angle of the sound signal.

5. The microphone array system of claim 4, wherein the signal source location detector comprises:

a speech signal detector to split each sound signal received from the input unit into the frequency components, into which the frequency splitter further splits the sound signal, to group the sound signals having the same frequency component, thereby generating a plurality of groups for the respective frequency components, and to measure a speech presence probability in each group;

a group selector to select a predetermined number of groups in descending order of speech presence probability from among the plurality of groups; and an arithmetic unit to perform the multiple signal classification algorithm with respect to frequency components corresponding to the respective selected groups.

6. A speech recognition system comprising:

a microphone array system;

a feature extractor to extract a feature of a sound signal received from the microphone array system;

a reference pattern storage unit to store reference patterns to be compared with the extracted feature;

a comparator to compare the extracted feature with the reference patterns stored in the reference pattern storage unit; and a determiner to determine whether a speech is recognized based on the compared result, wherein the microphone array system comprises:

an input unit to receive sound signals using a plurality of microphones;

a frequency splitter to split each sound signal received through the input unit into a plurality of narrowband signals;

an average spatial covariance matrix estimator which uses spatial smoothing to obtain a spatial covariance matrix for each frequency component of the sound signal, by which spatial covariance matrices for a plurality of virtual sub-arrays, which are configured in the plurality of microphones, are obtained with respect to each frequency component of the sound signal processed by the frequency splitter and then an average spatial covariance matrix is calculated;

a signal source location detector to detect an incidence angle of the sound signal according to the average spatial covariance matrix calculated using the spatial smoothing;

a signal distortion compensator to calculate a weight for each frequency component of the sound signal based on the incidence angle of the sound signal and multiply the calculated weight by each frequency component, thereby compensating for distortion of each frequency component; and a signal restoring unit to restore a sound signal using the distortion compensated frequency components, wherein the spatial smoothing is performed according to an equation $$\overline{R}_k = \frac{1}{p}\sum_{i=1}^{p} E\left[x_k^{(i)}(x_k^{(i)})^H\right],$$

where "p" indicates a number of the virtual sub-arrays, $x_k^{(i)}$ indicates a vector of an i-th sub-array microphone input signal, "k" indicates a k-th frequency component in a narrowband, and $\overline{R}_k$ indicates an average spatial covariance matrix.

7. The speech recognition system of claim 6, wherein the incidence angle $\theta_1$ of the sound signal is calculated using the $\overline{R}_k$ and a multiple signal classification (MUSIC) algorithm, and the calculated incidence angle is applied to $$W_k = \frac{\overline{R}_k^{-1} a_k(\theta_1)}{a_k^H(\theta_1)\overline{R}_k^{-1} a_k(\theta_1)}$$

to calculate a weight to be multiplied by each frequency component of the sound signal.

8. The speech recognition system of claim 6, wherein the signal source location detector splits each sound signal received from the input unit into the frequency components, into which the frequency splitter splits the sound signal, and performs a multiple signal classification multiple signal classification algorithm only to frequency components selected according to a predetermined reference from among the split frequency components, thereby determining the incidence angle of the sound signal.

9. The speech recognition system of claim 8, wherein the signal source location detector comprises:

a speech signal detector to split each sound signal received from the input unit into the frequency components, the frequency splitter further splits the sound signal, to group the sound signals having the same frequency component, thereby generating a plurality of groups for the respective frequency components, and to measure a speech presence probability in each group;

a group selector to select a predetermined number of groups in descending order of speech presence probability from among the plurality of groups; and an arithmetic unit to perform the multiple signal classification algorithm with respect to frequency components corresponding to the respective selected groups.

10. A microphone array method comprising: receiving a plurality of wideband sound signals from an array having a plurality of microphones; splitting each wideband sound signal into a plurality of narrowbands; obtaining spatial covariance matrices for a plurality of virtual sub-arrays, which include a plurality of microphones constituting the array of the plurality of microphones, with respect to each narrowband using a predetermined scheme and averaging the obtained spatial covariance matrices, thereby obtaining an average spatial covariance matrix for each narrowband; calculating an incidence angle of each wideband sound signal using the average spatial covariance matrix for each narrowband and a predetermined algorithm; calculating weights to be respectively multiplied with the narrowbands according to the incidence angle of the wideband sound signal and multiplying the weights by the respective narrowbands; and restoring a wideband sound signal using the narrowbands after being multiplied by the weights respectively, wherein the obtaining of the spatial covariance matrices comprises performing the spatial smoothing according to an equation:

$$\overline{R}_k = \frac{1}{p}\sum_{i=1}^{p} E\left[x_k^{(i)}(x_k^{(i)})^H\right]$$

where "p" indicates a number of the virtual sub-arrays, $x_k^{(i)}$ indicates a vector of an i-th sub-array microphone input signal, "k" indicates a k-th frequency component in a narrowband, and $R_k$ indicates an average spatial covariance matrix.

11. The microphone array method of claim 10, wherein the splitting is based on discrete Fourier transform, and the restoring is based on inverse discrete Fourier transform.

12. The microphone array method of claim 10, wherein the calculating of the incidence angle $\theta_1$ of the sound signal comprises calculating using the $\overline{R}_k$ and a multiple signal classification (MUSIC) algorithm, and the calculating and multiplying of the weights comprises applying the calculated incidence angle is applied to $$W_k = \frac{\overline{R}_k^{-1} a_k(\theta_1)}{a_k^H(\theta_1)\overline{R}_k^{-1} a_k(\theta_1)}$$

to calculate a weight to be multiplied by each frequency component of the sound signal.

13. The microphone array method of claim 10, wherein the calculating of the incidence angle comprises:

splitting each sound signal received from the array having the plurality of microphones into the frequency components of the split sound signal; and performing a multiple signal classification algorithm with respect to only frequency components selected according to a predetermined reference from among the split frequency components, thereby determining the incidence angle of the sound signal.

14. The microphone array method of claim 13, wherein the calculating of the incidence angle further comprises:

splitting each sound signal received from the array having the plurality of microphones into the frequency components of the split sound signal;

grouping the sound signals having the same frequency component, thereby generating a plurality of groups for the respective frequency components to measure a speech presence probability in each group;

selecting a predetermined number of groups in descending order of speech presence probability from among the plurality of groups; and performing the multiple signal classification algorithm with respect to frequency components corresponding to the respective selected groups.

15. A microphone array method comprising: receiving wideband sound signals from an array having a plurality of microphones; splitting each wideband sound signal into a plurality of narrowbands; obtaining spatial covariance matrices for a plurality of virtual sub-arrays, which include a plurality of microphones constituting the array of the plurality of microphones, with respect to each narrowband using a predetermined scheme, and averaging the obtained spatial covariance matrices, thereby obtaining an average spatial covariance matrix for each narrowband; calculating an incidence angle of each wideband sound signal using the average spatial covariance matrix for each narrowband and a predetermined algorithm; calculating weights to be respectively multiplied with the narrowbands based on the incidence angle of the wideband sound signal and multiplying the weights by the respective narrowbands; restoring a wideband sound signal using the narrowbands after being multiplied by the weights respectively; extracting a feature of a sound signal received from the microphone array system; storing reference patterns to be compared with the extracted feature; comparing the extracted feature with the reference patterns stored; and determining based on a comparison result whether a speech is recognized, wherein the obtaining of the spatial covariance matrices comprises performing the spatial smoothing according to an equation:

$$\overline{R}_k = \frac{1}{p}\sum_{i=1}^{p} E\left[x_k^{(i)}(x_k^{(i)})^H\right]$$

where "p" indicates a number of the virtual sub-arrays, $x_k^{(i)}$ indicates a vector of an i-th sub-array microphone input signal, "k" indicates a k-th frequency component in a narrowband, and $R_k$ indicates an average spatial covariance matrix.

16. The microphone array method of claim 15, wherein the splitting is based on discrete Fourier transform, and the restoring is based on inverse discrete Fourier transform.

17. The microphone array method of claim 15, wherein the calculating of the incidence angle $\theta_1$ of the sound signal comprises calculating using the $\overline{R}_k$ and a multiple signal classification (MUSIC) algorithm, and the calculating and multiplying of the weights comprises applying the calculated incidence angle is applied to $$W_k = \frac{\overline{R}_k^{-1} a_k(\theta_1)}{a_k^H(\theta_1)\overline{R}_k^{-1} a_k(\theta_1)}$$

to calculate a weight to be multiplied by each frequency component of the sound signal.

18. The microphone array method of claim 15, wherein the calculating step of the incidence angle, comprises:

splitting each sound signal received from the array having the plurality of microphones into the frequency components of the split sound signal; and performing a multiple signal classification algorithm with respect to only frequency components selected according to a predetermined reference from among the split frequency components, thereby determining the incidence angle of the sound signal.

19. The microphone array method of claim 18, wherein the calculating step of the incidence angle further comprises:

splitting each sound signal received from the array having the plurality of microphones into the frequency components of the split sound signal;

grouping the sound signals having the same frequency component, thereby generating a plurality of groups for the respective frequency components and measuring a speech presence probability in each group;

selecting a predetermined number of groups in descending order of speech presence probability from among the plurality of groups; and performing the MUSIC algorithm with respect to frequency components corresponding to the respective selected groups.

20. A microphone array input type speech recognition system using spatial filtering and having a microphone array to receive sound signals, the system comprising:

an average spatial covariance matrix estimator which uses spatial smoothing to produce a spatial covariance matrix for each frequency component of the received sound signals, by which spatial covariance matrices for a plurality of virtual sub-arrays, which are configured in the microphones array, are obtained with respect to each frequency component of the sound signals and an average spatial covariance matrix is calculated;

a signal source location detector to detect a source location of each of the sound signals using the average spatial covariance matrices;

a signal distortion compensator to calculate a weight matrix to be multiplied by each frequency component using the detected source location of each of the sound signals in order to compensate for distortion due to noise and an echo of a sound signal; and an input unit to receive each of the sound signals, the input unit having an array of M microphones and a plurality of virtual sub-arrays of L microphones, wherein the spatial smoothing is performed according to an equation $$\overline{R}_k = \frac{1}{p}\sum_{i=1}^{p} E\left[x_k^{(i)}(x_k^{(i)})^H\right],$$

where "p" indicates a number of the virtual sub-arrays, $x_k^{(i)}$ indicates a vector of an i-th sub-array microphone input signal, "k" indicates a k-th frequency component inanarrowband, and $\overline{R}_k$ indicates an average spatial covariance matrix.

21. The microphone array input type speech recognition system of claim 20, further comprising a signal restoring unit to restore each of the sound signals using the distortion compensated frequency components.

22. The microphone array input type speech recognition system of claim 21, further comprising a speech recognition module to obtain a speech recognition result by comparing a feature of each of the restored sound signals with a plurality of reference patterns to determine a sound most similar to the restored sound signal.

23. The microphone array input type speech recognition system of claim 22, wherein the speech recognition module further comprises:

a feature extractor unit to extract a feature vector of each of the restored sound signals;

a reference pattern storage unit to store the reference patterns for a plurality of sounds;

a determination unit to compare the extracted feature vector with the reference patterns stored to search for a sound similar to the restored sound signal, wherein the reference pattern with a highest correlation value exceeding a predetermined value is recognized as the sound signal.

24. The microphone array input type speech recognition system of claim 20, further comprising a frequency splitter to split each of the sound signals received through the input unit into a plurality of narrowband frequency signals.

25. The microphone array input type speech recognition system of claim 20, wherein the frequency splitter uses a discrete Fourier transform to split each of the sound signals received into narrowband frequency signals.

26. The microphone array input type speech recognition system of claim 25, wherein the signal source location detector splits each of the sound signals received from the input unit into the frequency components, into which the frequency splitter splits each of the sound signals, and performs a multiple signal classification algorithm only to frequency components selected according to a predetermined reference from among the split frequency components, thereby determining the location of each of the sound signals.

27. The microphone array input type speech recognition system of claim 26, wherein the signal source location detector detects the location of each of the sound signals using a respective incidence angle.

28. The microphone array input type speech recognition system of claim 20, further comprising a signal restoring unit to restore each of the sound signals using the distortion compensated frequency components from the signal distortion compensator.

29. The microphone array input type speech recognition system of claim 28, wherein the signal restoring unit uses inverse a discrete Fourier transform to restore each of the sound signals.

30. The microphone array input type speech recognition system of claim 20, wherein the incidence angle $\theta_1$ of each of the sound signals is calculated using the $\overline{R}_k$ and a multiple signal classification algorithm, and the calculated incidence angle is applied to $$W_k = \frac{\overline{R}_k^{-1} a_k(\theta_1)}{a_k^H(\theta_1)\overline{R}_k^{-1} a_k(\theta_1)}$$

to calculate a weight to be multiplied by each frequency component of each of the sound signals.

31. The microphone array input type speech recognition system of claim 20, wherein the signal source location detector is a wideband multiple signal classification unit and the signal distortion compensator is a wideband minimum variance unit.

32. The microphone array input type speech recognition system of claim 20, further comprising a frequency bin selector to select frequency bins likely to include a speech signal according to a predetermined reference such that the signal source location detector performs the multiple signal classification algorithm with respect to only frequency components corresponding to the respective selected frequency bins.

33. The microphone array input type speech recognition system of claim 32, further comprising a discrete Fourier transformer to perform a fast Fourier transform on each of the input sound signals.

34. The microphone array input type speech recognition system of claim 32, wherein the signal source detector further comprises a peak detector to determine a direction of each of the sound signals.

35. A microphone array input type speech recognition method of receiving sound signals and using spatial filtering to acquire a high-quality speech signal for recognizing speech, the method comprising:

obtaining a spatial covariance matrix for each frequency component of the received sound signals, using spatial smoothing, by which spatial covariance matrices for a plurality of virtual sub-arrays, which are configured in the microphones array, are obtained with respect to each frequency component of the sound signals and an average spatial covariance matrix is calculated;

detecting a source location of each of the sound signals using the average spatial covariance matrices; and calculating a weight matrix to be multiplied by each frequency component using the detected source location of each of the sound signals in order to compensate for distortion due to noise and an echo of a sound signal, wherein the spatial smoothing is performed according to an equation $$\overline{R}_k = \frac{1}{p}\sum_{i=1}^{p} E\left[x_k^{(i)}(x_k^{(i)})^H\right],$$

where "p" indicates a number of the virtual sub-arrays, $x_k^{(i)}$ indicates a vector of an i-th sub-array microphone input signal, "k" indicates a k-th frequency component in a narrowband, and $\overline{R}_k$ indicates an average spatial covariance matrix.

36. The microphone array input type speech recognition method of claim 35, further restoring each of the sound signals using the distortion compensated frequency components.

37. The microphone array input type speech recognition method of claim 36, further comprising obtaining a speech recognition result by comparing a feature of each of the restored sound signals with a plurality of reference patterns to determine a sound most similar to the restored sound signal.

38. The microphone array input type speech recognition method of claim 37, wherein the speech recognition module further comprises:

extracting a feature vector of each of the restored sound signals;

storing the reference patterns for a plurality of sounds;

comparing the extracted feature vector with the reference patterns stored to search for a sound similar to the restored sound signal, wherein the reference pattern with a highest correlation value exceeding a predetermined value is recognized as the sound signal.

39. The microphone array input type speech recognition method of claim 35, further comprising splitting each of the sound signals received into a plurality of narrowband frequency signals.

40. The microphone array input type speech recognition method of claim 39, further comprising receiving each of the sound signals through an array of M microphones a plurality of virtual sub-arrays of L microphones.

41. The microphone array input type speech recognition method of claim 40, further comprising using a discrete Fourier transform to split each of the sound signals into narrowband frequency signals.

42. The microphone array input type speech recognition method of claim 39, wherein the detecting the source location of each of the sound signals, comprises:

splitting each of the sound signals received into the frequency components of each of the split sound signals; and performing a multiple signal classification algorithm with respect to only frequency components selected according to a predetermined reference from among the split frequency components, thereby determining the source location of each of the sound signals.

43. The microphone array input type speech recognition method of claim 42, wherein the detecting the source location of each of the sound signals, further comprises:

splitting each of the sound signals received into the frequency components of each of the split sound signals;

grouping each of the sound signals having the same frequency component, thereby generating a plurality of groups for the respective frequency components to measure a speech presence probability in each group;

selecting a predetermined number of groups in descending order of speech presence probability from among the plurality of groups; and performing the multiple signal classification algorithm with respect to frequency components corresponding to the respective selected groups.

44. The microphone array input type speech recognition method of claim 35, further comprising restoring each of the sound signals using the distortion compensated frequency components.

45. The microphone array input type speech recognition method of claim 35, wherein the restoring is calculated using a discrete Fourier transform.

46. The microphone array input type speech recognition method of claim 35, wherein the incidence angle $\theta_1$ of each of the sound signals is calculated using the $\overline{R_k}$ and a multiple signal classification algorithm, and the calculated incidence angle is applied to $$w_k = \frac{\overline{R_k}^{-1} a_k(\theta_1)}{a_k^H(\theta_1)\overline{R_k}^{-1} a_k(\theta_1)}$$

to calculate a weight to be multiplied by each frequency component of each of the sound signals.

47. The microphone array input type speech recognition method of claim 35, further comprising selecting frequency bins likely to include a speech signal according to a predetermined reference such that the multiple signal classification algorithm is performed with respect to only frequency components corresponding to the respective selected frequency bins.

48. The microphone array input type speech recognition method of claim 47, further comprising performing a fast Fourier transform on each of the input sound signals.

49. The microphone array input type speech recognition method of claim 47, further comprising detecting a peak of the each of the sound signals to determine a direction of each of the sound signals.

* * * * *

UNITED STATES PATENT AND TRADEMARK OFFICE

CERTIFICATE OF CORRECTION

PATENT NO. : 7,567,678 B2
APPLICATION NO. : 10/836207
DATED : July 28, 2009
INVENTOR(S) : Dong-geon Kong et al.

It is certified that error appears in the above-identified patent and that said Letters Patent is hereby corrected as shown below:

Title Page, Item (57) (Abstract), Line 14, change "calculates" to --calculate--.

Column 19, Line 45, change "$W_k = \frac{\overline{R_k}^{-1} a_k(\theta_1)}{a_k^H(\theta_1)\overline{R_k}^{-1} a_k(\theta_1)}$" to -- $W_k = \frac{\overline{R}_k^{-1} a_k(\theta_1)}{a_k^H(\theta_1)\overline{R}_k^{-1} a_k(\theta_1)}$ --.

Column 21, Line 65, change "$W_k = \frac{\overline{R_k}^{-1} a_k(\theta_1)}{a_k^H(\theta_1)\overline{R_k}^{-1} a_k(\theta_1)}$" to -- $W_k = \frac{\overline{R}_k^{-1} a_k(\theta_1)}{a_k^H(\theta_1)\overline{R}_k^{-1} a_k(\theta_1)}$ --.

Column 22, Lines 61-62, change "inanarrowband," to --in a narrowband,--.

Column 23, Line 60, change "$W_k = \frac{\overline{R_k}^{-1} a_k(\theta_1)}{a_k^H(\theta_1)\overline{R_k}^{-1} a_k(\theta_1)}$" to -- $W_k = \frac{\overline{R}_k^{-1} a_k(\theta_1)}{a_k^H(\theta_1)\overline{R}_k^{-1} a_k(\theta_1)}$ --.

UNITED STATES PATENT AND TRADEMARK OFFICE

CERTIFICATE OF CORRECTION

PATENT NO. : 7,567,678 B2
APPLICATION NO. : 10/836207
DATED : July 28, 2009
INVENTOR(S) : Dong-geon Kong et al.

It is certified that error appears in the above-identified patent and that said Letters Patent is hereby corrected as shown below:

Column 26, Line 20, change "

$$W_k = \frac{\overline{R_k}^{-1} a_k(\theta_1)}{a_k^H(\theta_1)\overline{R_k}^{-1} a_k(\theta_1)}$$

" to

--

$$\mathbf{w}_k = \frac{\overline{\mathbf{R}}_k^{-1}\mathbf{a}_k(\theta_1)}{\mathbf{a}_k^H(\theta_1)\overline{\mathbf{R}}_k^{-1}\mathbf{a}_k(\theta_1)}$$

--.

Signed and Sealed this

First Day of December, 2009

David J. Kappos

David J. Kappos
*Director of the United States Patent and Trademark Office*